US009038249B2

(12) United States Patent
Keyaki et al.

(10) Patent No.: US 9,038,249 B2
(45) Date of Patent: May 26, 2015

(54) SLIDER FOR CONCEALED SLIDE FASTENER

(75) Inventors: Keiichi Keyaki, Toyama (JP); Yuichi Iwase, Toyama (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 13/392,547

(22) PCT Filed: Aug. 27, 2009

(86) PCT No.: PCT/JP2009/064927

§ 371 (c)(1),
(2), (4) Date: Feb. 27, 2012

(87) PCT Pub. No.: WO2011/024273

PCT Pub. Date: Mar. 3, 2011

(65) Prior Publication Data

US 2012/0151719 A1 Jun. 21, 2012

(51) Int. Cl.
*A44B 19/26* (2006.01)
*A44B 19/08* (2006.01)

(52) U.S. Cl.
CPC ..... *A44B 19/26* (2013.01); *Y10T 24/2582* (2015.01); *A44B 19/08* (2013.01)

(58) Field of Classification Search
CPC .... A44B 19/26; A44B 19/306; A44B 19/308; A44B 19/32; A44B 19/14; A44B 19/267; Y10T 24/2571; Y10T 24/2582; Y10T 24/2588; Y10T 24/2561; Y10T 24/2568; Y10T 24/2514; Y10T 24/2566; Y10T 24/2577; Y10T 24/2536; Y10T 24/257; Y10T 24/258; Y10T 24/2591; B29D 5/00; B29D 29/06; B29D 3/18
USPC ..... 24/418, 421, 430, 427
See application file for complete search history.

(56) References Cited

U.S. PATENT DOCUMENTS 2,405,509 A * 8/1946 Marinsky ..... 24/430
3,011,238 A * 12/1961 McNamara ..... 24/427
3,011,251 A 12/1961 McNamara (Continued)

FOREIGN PATENT DOCUMENTS

FR 2205289 5/1974
JP S53-128007 A 3/1952

(Continued)

OTHER PUBLICATIONS

Office Action, Japanese Patent Application No. 2011-528555, mailed Nov. 6, 2012.

(Continued)

*Primary Examiner* — Robert J Sandy
*Assistant Examiner* — David Upchurch
(74) *Attorney, Agent, or Firm* — Kilpatrick Townsend & Stockton LLP

(57) ABSTRACT

Providing a slider for a concealed slide fastener, capable of achieving a smooth sliding operation of the slider, even when the slider is applied to a seat cover for a seat and strong lateral pulling force is applied to the slider when the slide fastener is closed. A slider for a concealed slide fastener comprises a slider body having at least a lower blade, left and right side wall portions and left and right first flanges, and slider upper plate member engaged with the slider body and having at least a second flange projecting toward at least the left and right side wall portions.

15 Claims, 16 Drawing Sheets

(56) References Cited

U.S. PATENT DOCUMENTS

| | | | | | |
|---|---|---|---|---|---|
| 3,423,802 | A | * | 1/1969 | Hytonen | 24/401 |
| 3,492,960 | A | * | 2/1970 | Fujisaki | 112/235 |
| 3,991,447 | A | * | 11/1976 | Akashi | 24/430 |
| 4,000,546 | A | * | 1/1977 | Takamatsu | 24/427 |
| 4,055,876 | A | | 11/1977 | Ackermann et al. | |
| 4,980,954 | A | * | 1/1991 | Takabatake et al. | 24/421 |
| 5,255,418 | A | * | 10/1993 | Chen | 24/424 |
| 5,297,320 | A | * | 3/1994 | Keyaki et al. | 24/430 |
| 6,490,770 | B1 | * | 12/2002 | Matsuda et al. | 24/428 |
| 6,622,351 | B2 | * | 9/2003 | Takasawa | 24/415 |
| 7,000,293 | B2 | * | 2/2006 | Lin | 24/415 |
| 7,207,092 | B2 | * | 4/2007 | Iwase et al. | 24/421 |
| 7,337,510 | B2 | * | 3/2008 | Yamagishi et al. | 24/421 |
| 8,091,186 | B2 | * | 1/2012 | Takazawa et al. | 24/415 |
| 2006/0000066 | A1 | | 1/2006 | Lin | |
| 2006/0075611 | A1 | * | 4/2006 | Yamagishi et al. | 24/418 |
| 2007/0107171 | A1 | | 5/2007 | Kojima | |

FOREIGN PATENT DOCUMENTS

| | | | |
|---|---|---|---|
| JP | 52-150149 | | 12/1997 |
| JP | 2007-054176 | | 3/2007 |
| JP | 2007-135722 | | 6/2007 |
| JP | 2009-045226 | A | 3/2009 |

OTHER PUBLICATIONS

International Search Report and Written Opinion, PCT International Application No. PCT/JP2009/064927 mailed Dec. 1, 2009.

Office Action, Japanese Patent Application No. 2011-528555, mailed Jul. 2, 2013.

Office Action, Australian Patent Application No. 2009351749, mailed Jan. 16, 2014.

Supplementary European Search Report, European Patent Application No. 09848721.8, mailed Feb. 17, 2015.

* cited by examiner

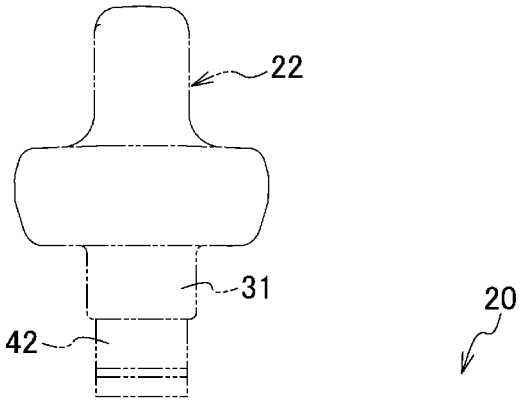
FIG.12A
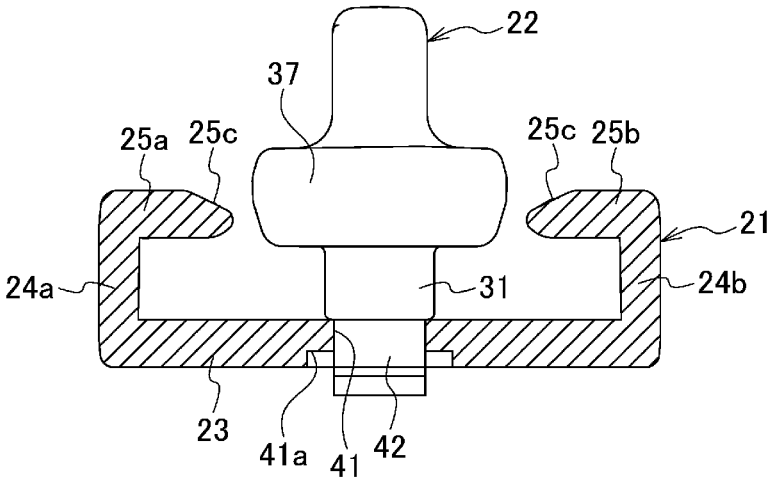
FIG.12B
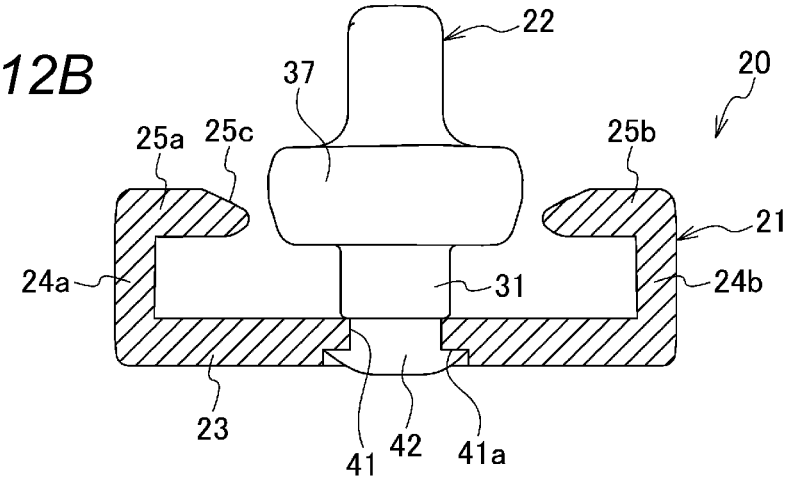

SLIDER FOR CONCEALED SLIDE FASTENER

This application is a national stage application of PCT/JP2009/064927, which is incorporated herein by reference.

TECHNICAL FIELD

The present invention relates to a slider for a concealed slide fastener, and more particularly, to a slider for a concealed slide fastener, capable of achieving a smooth slider operation even when a strong lateral pulling force is applied when the slide fastener is closed.

BACKGROUND ART

This kind of concealed slide fastener has been often used for women's clothes. The concealed slide fastener has, however, been applied to other fields, for example, a passenger seat of an automobile or a train in recent years. In the passenger seat, the cushion body formed integrally with a frame in advance is covered with a seat cover. At this time, the size of the seat cover is set smaller than the external dimension of the cushion body, so that the cushion body is covered with the seat cover under the compressed state so as to suppress looseness and deformation which may occur in its external shape as much as possible. Further, in order to easily cope with the load distribution of a human body when the passenger takes a seat, the seat cover allows the cushion body, even if it is elastically deformed, to reliably restored to its original shape when the passenger leaves the seat, thereby preventing the cushion body from deformation.

The seat cover is typically made of a sheet in which an outer layer, a thin elastic intermediate layer and a back base fabric layer are integrally laminated by the laminating process etc. The outer layer is comprised of a natural leather, a synthetic leather, or a knitted/woven fabric having various structures. The intermediate layer is comprised of a polyurethane foamed sheet or the like. The back base fabric layer is comprised of a thin knitted/woven fabric or the like obtained by weaving or knitting using extremely thin yarns. This sheet is typically cut into a plurality of sheet pieces according to the shape of a passenger seat, and these sheet pieces are sewed together three-dimensionally to produce a seat cover. However, if the entire seat cover is manufactured by sewing, a cushion body having a complicated external shape may not often be covered with the seat cover. For this reason, up to now, a part of the seat cover is not sewed in advance. After the seat cover is covered on the cushion body, the non-sewed part is sewed by hand.

However, in this sewing process based on the sewing by hand, the finished products are apt to be different in quality or sewing time depending on a difference of the skill of a sewing operator. As such, to eliminate the sewing by hand, a slide fastener, particularly a concealed slide fastener whose slider body is not exposed to the outside, has recently been often used along a part, e.g. a seaming part, of the sewing section of the seat cover. As a result, the entire sewing process can be carried out by a sewing machine, so that the conventional faults based on the skill difference are considerably reduced, and the productivity is further improved.

As such a conventional concealed slide fastener, as disclosed in, for example, Patent Document 1, there is used a slider including left and right side wall portions erected from left and right edges of a lower blade of a slider body, left and right first flanges extending from upper ends of the side wall portions in a mutually approaching direction, a guide post erected on a central portion of one end of the lower blade in a sliding direction, a second flange protruding outwardly along an outer circumference of the guide post, and a pull-tap attaching post provided on a top surface of the second flange.

A space defined by the first flanges, the guide post and the second flange becomes a guide passage of an engaging element row, and gaps formed between the first flanges and the second flange serves as a guide gap for fastener tapes. On the other hand, in fastener stringers that are inserted into the slider having such a configuration, a plurality of engaging elements are attached along opposite side edges of a pair of fastener tapes by sewing or the like, with their meshing heads positioned inside. An element attaching edge of each of the pair of fastener stringers obtained in this way is bent in a-U shape such that the meshing head of each engaging element protrudes to the outside, and then is fixed in the bent shape by thermal setting. The pair of fastener stringers having such a structure are inserted into the slider by causing folded portions of the fastener tapes to extend outwards through the tape guide gap between the first and second flanges with the meshing heads of the elements being opposite to each other in shoulder mouths of the slider. Thereby, a concealed slide fastener is obtained.

Here, when the concealed slide fastener is applied to the seat cover of the passenger seat of the automobile as mentioned above, a strong lateral pulling force is applied to the fastener stringers in the vicinity of the slider because the seat cover is formed so as to be smaller than the external dimension of the cushion body. The engaging elements stand up due to the strong lateral pulling force. Each element, which is introduced into the shoulder mouths of the second flange while its part near the shoulder mouths is placed under the lateral pulling force, stands up until it becomes approximately perpendicular to a tape surface of the fastener tape.

For this reason, in the slider for the concealed slide fastener disclosed in Patent Document 1, an upper end ridge of a taper surface of the second flange on the side of the shoulder mouths is set to be higher with respect to the lower blade than that of a rear mouth, so that the elements are guided along the taper surface of the second flange without interfering with the second flange although the elements are mounted on the lower blade in a slightly tilted posture, and thus are introduced into the element guide passage of the slider. During the introduction, the elements are subjected to the overall influence of the guide by the taper surface, and a tilting force caused by the pulling force of the preceding elements and the fastener tapes, and thus are gradually inclined so as to take a posture in which coupling portions of the elements attempt to crawl into a lower surface of the second flange, and prevents the meshing heads of the elements from being nipped between the first and second flanges of the lower blade, thereby promoting smooth sliding of the slider.

PRIOR ART DOCUMENT(S)

Patent Document

Patent Document 1: Japanese Patent Application Publication No. 2007-054176

SUMMARY OF INVENTION

Problems to be Solved by Invention

However, in the slider for the concealed slide fastener, as disclosed in Patent Document 1, which comprises a slider body in which the lower blade, the left and right side wall portions, the left and right first flanges, the guide post, the second flange, and the pull-tap attaching post are integrally formed, due to the restrictions of a metal mold when manufacturing the slider, it is impossible to increase a width of the second flange, and an outer surface of the second flange is expanded from the rear mouth-side toward the shoulder mouths-side in a taper shape, and is linearly formed along a sliding direction at a leading end part at the shoulder mouths-side. Therefore, the guide gaps for the fastener tapes, formed between the first and second flanges are expanded from the rear mouth-side toward the shoulder mouths-side in a taper shape, and are linearly formed along a sliding direction at a leading end part at the shoulder mouths-side. For this reason, when the fastener stringers on which the strong lateral pulling force acts are inserted into the slider, sliding resistance of the slider is still high, and thus it is necessary to close the fastener while pulling the seat cover. Additional improvement is required to improve work efficiency.

Accordingly, the present invention has been made keeping in mind the above problems, and an object of the present invention is to provide a slider for a concealed slide fastener, capable of achieving a smooth sliding operation of the slider even if the slider is applied to a seat cover of a passenger seat or the like, and a strong lateral pulling force is applied when the slide fastener is closed.

Means for Solving Problems

The object of the present invention is achieved by the following configurations.

(1) A slider for a concealed slide fastener which engages and disengages fastener elements of a pair of fastener stringers in which opposite side edges of fastener tapes are bent and fixed into U-shapes and the fastener elements are attached along bent end edges of the side edges, the slider comprising:

a lower blade;

left and right side wall portions erected along side edges of the lower blade in a right and left direction;

left and right first flanges extending from upper ends of the left and right side wall portions in a mutually approaching direction;

a guide post disposed between the left and right first flanges and extending from a central portion of the lower blade in the right and left direction at a shoulder mouths-side toward a rear mouth;

a second flange protruding from an upper portion of the guide post toward at least the left and right first flanges and the rear mouth; and a pull-tab attaching portion for supporting a pull tab, wherein the slider is comprised of a slider body having at least the lower blade, the left and right side wall portions and the left and right first flanges, and a slider upper plate member engaged with the slider body and having at least the second flange, wherein the guide post is provided in one of the slider body and the slider upper plate member, and wherein the pull-tab attaching portion is provided in one of the slider body and the slider upper plate member.

(2) The slider for the concealed slide fastener, according to (1), wherein the slider body includes a slider body-side engaging part formed at a central portion of the lower blade in the right and left direction at the shoulder mouths-side, and wherein the slider upper plate member includes a slider upper plate member-side engaging part engaged with the slider body-side engaging part and formed below the second flange.

(3) The slider for the concealed slide fastener, according to (1), wherein the slider upper plate member is configured such that the slider body-side engaging part is engaged with the slider upper plate member-side engaging part by relatively moving the slider upper plate member from a rear mouth-side toward a shoulder mouths-side of the slider body, and wherein one of the slider body-side engaging part and the slider upper plate member-side engaging part is integrally formed with a contact wall that restricts the slider upper plate member after engagement from moving further toward the shoulder mouths-side.

(4) The slider for the concealed slide fastener, according to (3), wherein one of the slider body-side engaging part and the slider upper plate member-side engaging part is a dovetail groove that is opened to one of a shoulder mouths-side and a rear mouth-side of the guide post, and wherein the other is an overhang portion having a shape corresponding to the dovetail groove and comprised of a standing portion and a rib protruding from an upper end of the standing portion in the right and left direction, the overhang portion having a substantially T-shape in cross section.

(5) The slider for the concealed slide fastener, according to (4), wherein an opposite side of an opening at which the dovetail groove is opened is closed by the contact wall.

(6) The slider for the concealed slide fastener, according to (5), wherein the guide post is provided in the slider upper plate member, wherein the slider upper plate member-side engaging part is provided with the dovetail groove that is opened to the shoulder mouths-side of the guide post and a pair of legs which are deformable so as to block the opening of the dovetail groove, wherein the slider body-side engaging part is the overhang portion having the substantially T-shape in cross section and comprised of the standing portion erected from the lower blade and the rib protruding outwardly from the upper end of the standing portion toward the left and right first flanges, and the pair of legs are deformed so as to block the opening after the overhang portion is inserted into the dovetail groove from the shoulder mouths-side.

(7) The slider for the concealed slide fastener, according to any one of (1) to (6), wherein the second flange has a width that is continuously increased from the rear mouth toward the shoulder mouths.

(8) The slider for the concealed slide fastener, according to any one of (1) to (7), wherein the left and right side wall portions are configured such that a width between inner surfaces at the shoulder mouths-side is continuously increased from the rear mouth-side toward the shoulder mouths.

(9) The slider for the concealed slide fastener, according to any one of (1) to (8), wherein a distance from a central line in the right and left direction perpendicular to a sliding direction of the slider to each outermost end of the second flange is equal to or more than 0.8 times a distance from the central line to each inner surface of the side wall portions at the rear mouth-side.

(10) The slider for the concealed slide fastener, according to (9), wherein the outermost ends of the second flange protrude in the right and left direction beyond the inner surfaces of the side wall portions at the rear mouth-side.

(11) The slider for the concealed slide fastener, according to any one of (1) to (10), wherein an end face of the slider upper plate member at the shoulder mouths-side has an inclined face that is gradually inclined from the shoulder mouths toward the rear mouth as it goes downward, and wherein the inclined face extends upward beyond an upper surfaces of the first flanges.

Advantageous Effects of Invention

According to the slider for the concealed slide fastener of the present invention, since the slider is comprised of two components of a slider body having at least a lower blade, side wall portions, and first flanges, and a slider upper plate member having a second flange and engaged with the slider body, a shape of the second flange is not restricted by a metal mold. Thereby, the fastener elements can be introduced into an element guide passage by the second flange with an ideal shape and be meshed while smoothly moving further toward the rear mouth-side. Thus, even when a strong lateral pulling force is applied when the slide fastener is closed, it is possible to smoothly slide the slider.

According to the slider for the concealed slide fastener of the present invention, the slider body has a slider body-side engaging part formed on the central portion of the lower blade in the right and left direction at the shoulder mouths-side, and the slider upper plate member has a slider upper plate member-side engaging part that is engaged with the slider body-side engaging part and is formed below the second flange. As such, the slider body and the slider upper plate member can be substantially integrated by engaging the slider body-side engaging part with the slider upper plate member-side engaging part, and the slider for the concealed slide fastener can be formed by two components.

Further, the slider body-side engaging part and the slider upper plate member-side engaging part are engaged by relatively moving the slider upper plate member from the rear mouth-side toward the shoulder mouths-side of the slider body. This engaging direction is equal to a sliding direction of the slider that meshes fastener elements of a pair of fastener stringers. It is possible to prevent the slider body-side engaging part from being disengaged from the slider upper plate member-side engaging part, even if a relatively great operating force acts on the slider upper plate member in which the pull-tab attaching portion is provided when the fastener elements are meshed with each other. Moreover, one of the slider body-side engaging part and the slider upper plate member-side engaging part is provided with a contact wall that restricts the slider upper plate member after engagement from moving further toward the shoulder mouths-side, so that it is possible to reliably prevent the slider upper plate member from moving after being engaged.

Further, according to the slider for the concealed slide fastener of the present invention, one of the slider body-side engaging part and the slider upper plate member-side engaging part is a dovetail groove that is opened to one of the shoulder mouths-side and the rear mouth side of the guide post, and the other is an overhang portion having a shape corresponding to the dovetail groove and comprised of a standing portion and a rib protruding from an upper end of the standing portion in the right and left direction, the overhang portion having a substantially T-shape in cross section. As such, by inserting (press-fitting) the overhang portion into the dovetail groove, the slider upper plate member can be reliably prevented from being disengaged from the slider body in an upward direction.

Further, since the opposite side of the opening at which the dovetail groove is opened is closed by a contact wall, the slider upper plate member can come into contact with the contact wall only by inserting the overhang portion into the dovetail groove, and be positioned and prevented from further movement after being engaged.

Further, the guide post is provided in the slider upper plate member, the slider upper plate member-side engaging part is provided with the dovetail groove that is opened to the shoulder mouths-side of the guide post and the pair of legs which are deformable so as to block the opening of the dovetail groove, and the slider body-side engaging part is the overhang portion having the substantially T-shape in cross section and comprised of the standing portion erected from the lower blade and the rib protruding outwardly from the upper end of the standing portion toward the left and right first flanges. The pair of legs are deformed so as to block the opening after the overhang portion is inserted into the dovetail groove from the shoulder mouths-side. As such, the slider body and the slider upper plate member can be reliably integrated.

Further, according to the slider for the concealed slide fastener of the present invention, the second flange has a width that is continuously increased from the rear mouth toward the shoulder mouths, so that the fastener elements can be guided by the second flange and pulled with a constant force, and thus the slider can smoothly slide. Further, the shape of the second flange whose width is continuously increased can be achieved by forming the slider upper plate member having the second flange so as to be independent of the slider body.

Further, according to the slider for the concealed slide fastener of the present invention, the left and right side wall portions are configured such that a width between the inner surfaces at the shoulder mouths-side is continuously increased from the rear mouth-side toward the shoulder mouths. Similarly, the side wall portions are disposed so as to face the second flange whose width is continuously increased from the rear mouth toward the shoulder mouths, so that gaps between outer surfaces of the second flange and the inner surfaces of the side wall portions can be maintained at an approximately constant interval. Thereby, it is possible to smoothly guide the fastener elements into the element guide passage, and to smoothly slide the slider.

Further, according to the slider for the concealed slide fastener of the present invention, since the distance from the central line in the right and left direction to each outermost end of the second flange is equal to or more than 0.8 times the distance from the central line to each inner surface of the side wall portions of the slider body at the rear mouth-side. As such, a slider in which the second flange which it is difficult to mold due to restrictions of the metal mold in a conventional slider (i.e. an integrally molded slider) is greatly formed is obtained. Thereby, the fastener elements taking a posture in which they stand up with respect to the fastener tapes at substantially right angles can be guided by the second flange and be pulled with a constant and relatively weak force. Thus, even when a strong lateral pulling force is applied when the slide fastener is closed, it is possible to smoothly slide the slider.

Meanwhile, the outermost ends of the second flange are preferably formed so as to protrude beyond the inner surfaces of the side wall portions at the rear mouth-side in the right and left direction. That is, a distance ratio of the distance from the central line to each outermost end of the second flange to the distance from the central line to each inner surface of the side wall portions of the slider body at the rear mouth-side is preferably more than 1. Further, the reason the distance from the central line to each outermost end of the second flange is equal to or more than 0.8 times the distance from the central line to each inner surface of the side wall portions of the slider body at the rear mouth-side is that, although the second flange can be theoretically formed by a metal mold for integral molding when the distance ratio is less than 1, a slide core becomes too slender to maintain a strength and thus it is difficult to produce a practical metal mold. For this reason, when the distance ratio of 0.8 times or more that has difficulty producing the metal mold in the integral molding, the slider of the present invention made up of two components is effective.

Further, according to the slider for the concealed slide fastener of the present invention, since the end face of the slider upper plate member at the shoulder mouths-side extends over the upper surfaces of the first flanges, and is gradually inclined from the shoulder mouths-side toward the rear mouth-side as it goes downward, the fastener elements can be introduced into the element guide passage while being guided and tilted by the end face even when the fastener elements stand up with respect to the fastener tapes at substantially right angles due to the action of a strong lateral pulling force. Thus, even when a strong lateral pulling force is applied when the slide fastener is closed, it is possible to smoothly slide the slider.

BRIEF DESCRIPTION OF DRAWINGS

FIGS. 12A and 12B are cross-sectional views showing an assembling sequence of the slider for the concealed slide fastener shown in FIG. 11.

EMBODIMENTS OF INVENTION

Hereinafter, a slider for a concealed slide fastener according to each embodiment of the present invention will be described in detail with reference to the accompanying drawings.

First Embodiment

Figure 1:
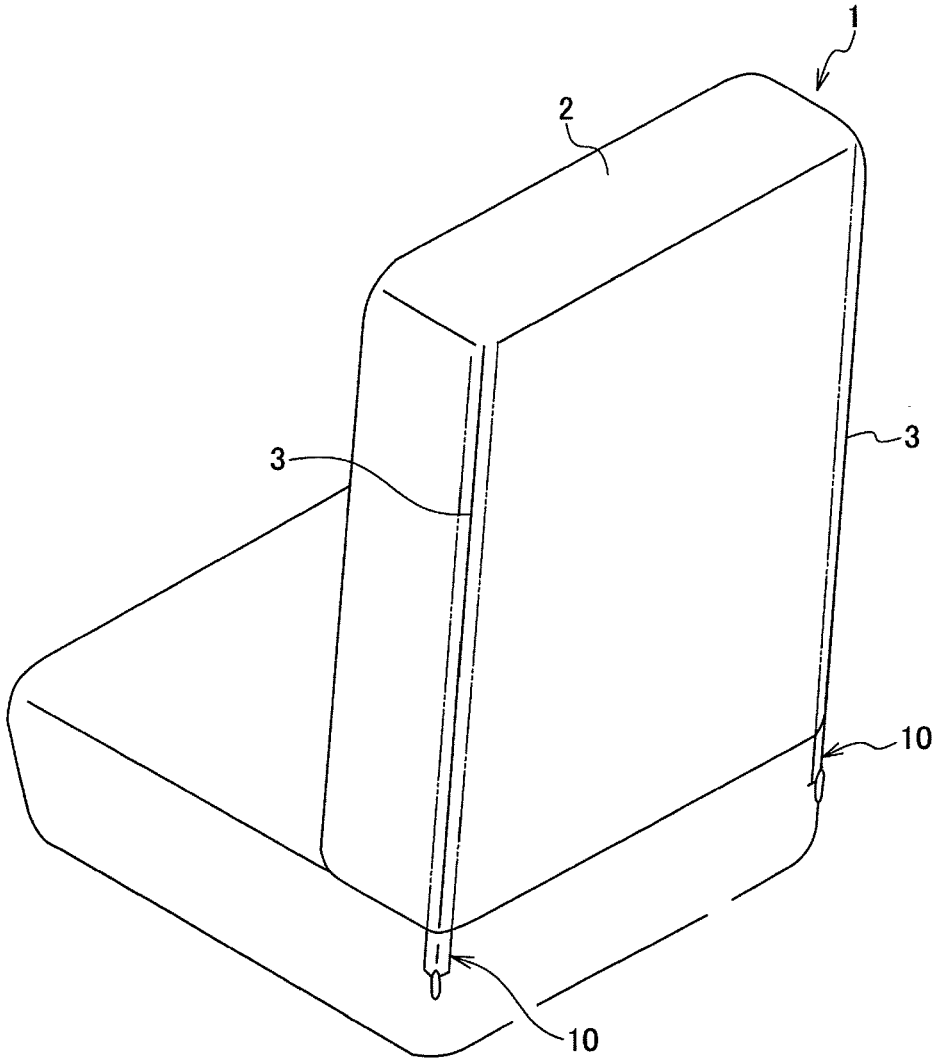
FIG. 1 is a perspective view showing a seat to which a slider for a concealed slide fastener according to a first embodiment of the present invention is applied.
Figure 2:
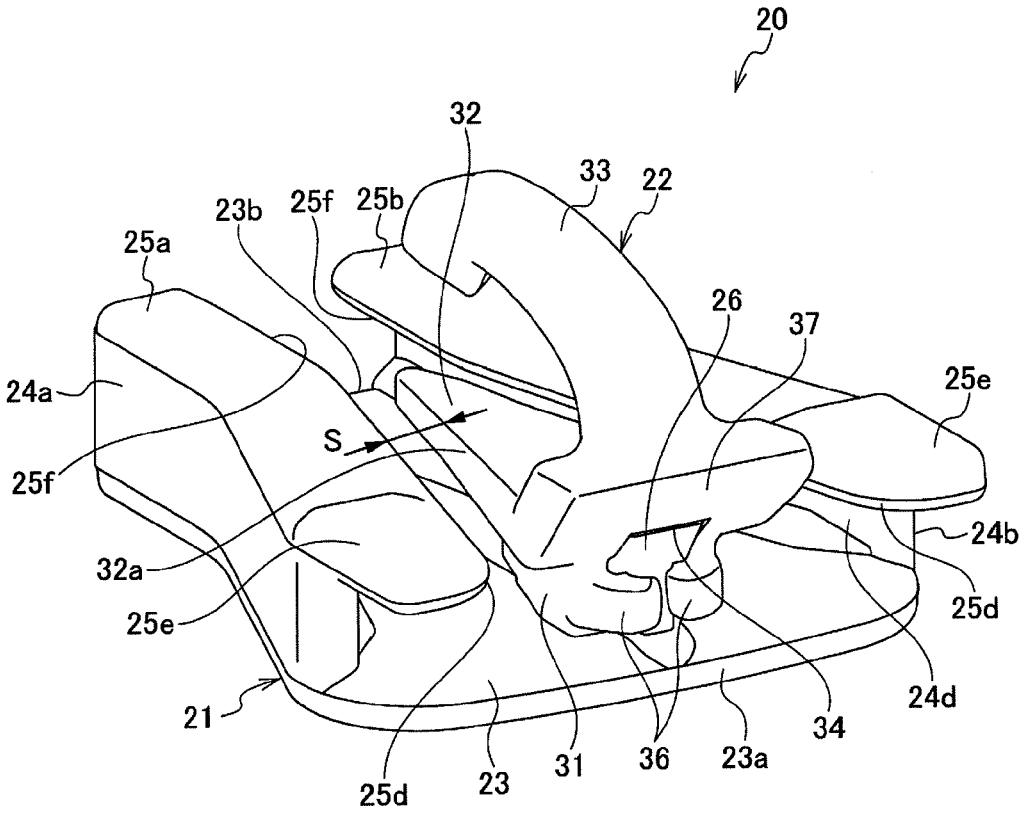
FIG. 2 is a perspective view showing a slider for a concealed slide fastener according to a first embodiment of the present invention.
Figure 3:
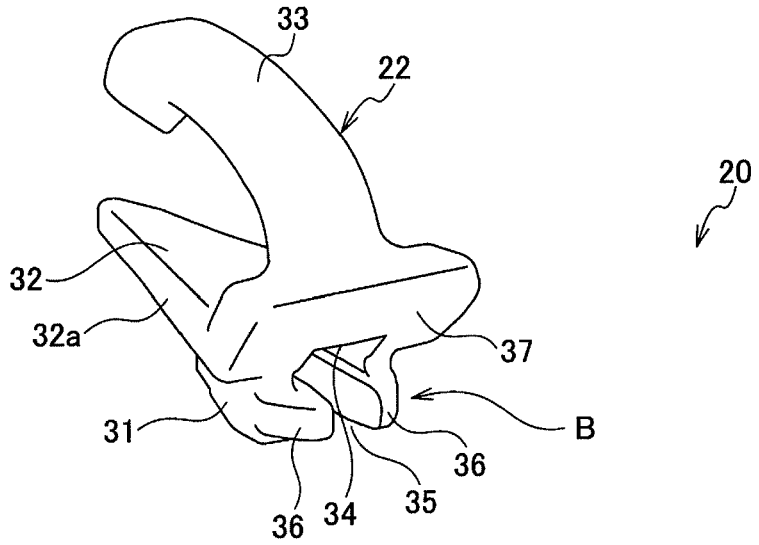
FIG. 3 is an exploded perspective view of the slider for the concealed slide fastener shown in FIG. 2.
Figure 3:
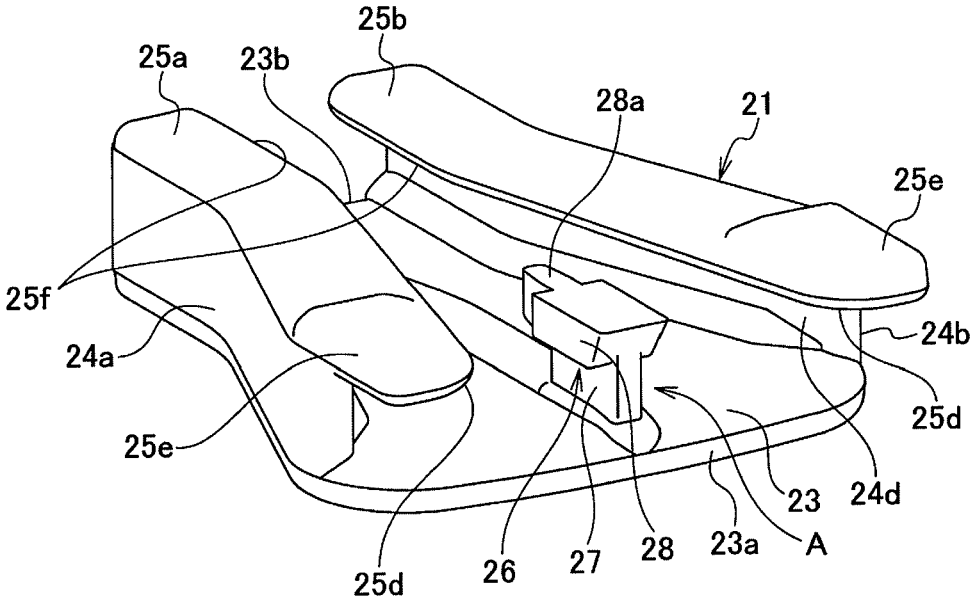

FIG. 1 is a perspective view showing a seat to which a slider for a concealed slide fastener according to a first embodiment of the present invention is applied. The seat 1 is configured so that a seat cover 2 covers on a cushion body that is integrally formed with a frame (not shown). The concealed slide fastener 10 is used along a part, for instance, a seaming part 3, of the seat cover 2. The concealed slide fastener 10 allows the cushion body to be covered with the seat cover 2 without fastener elements being exposed to the outside, so that the seat 1 having excellent appearance.

Figure 9:
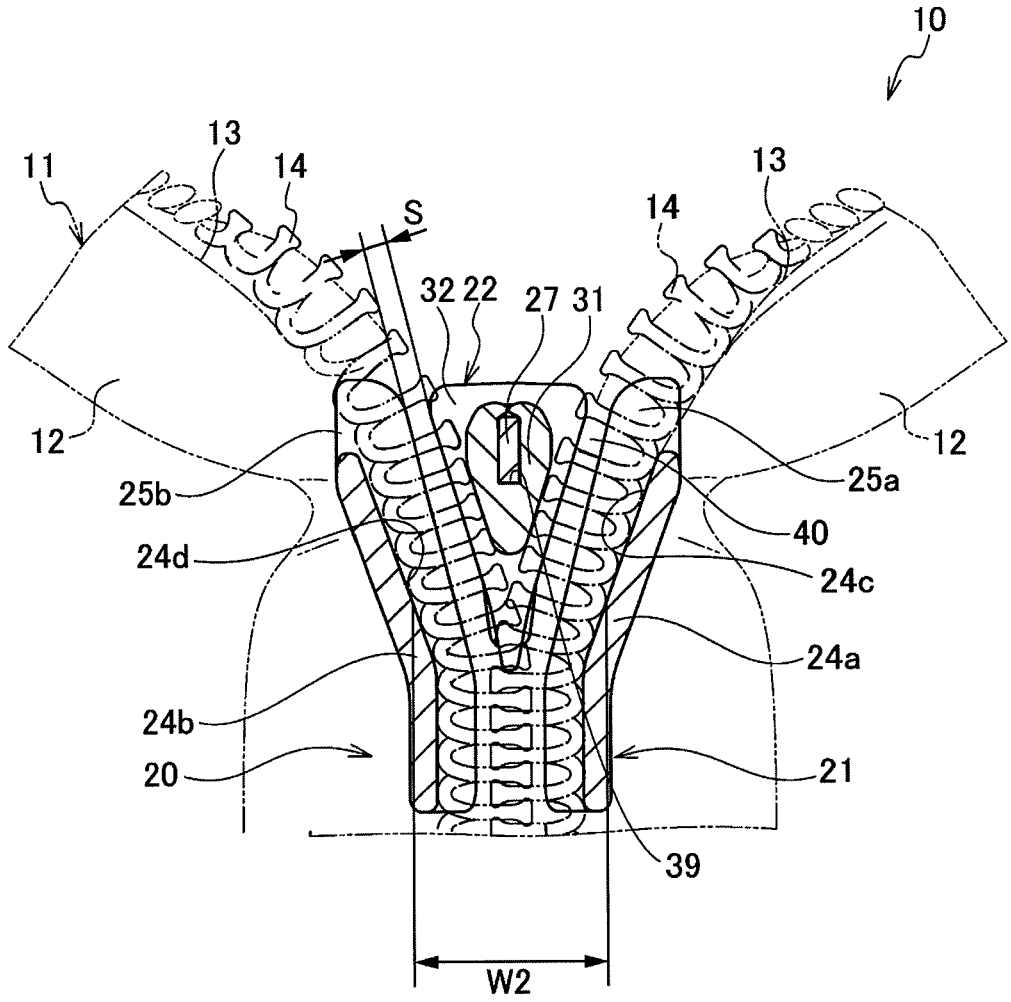
FIG. 9 is an explanatory view for explaining a behavior of meshed fastener elements.
Figure 10:
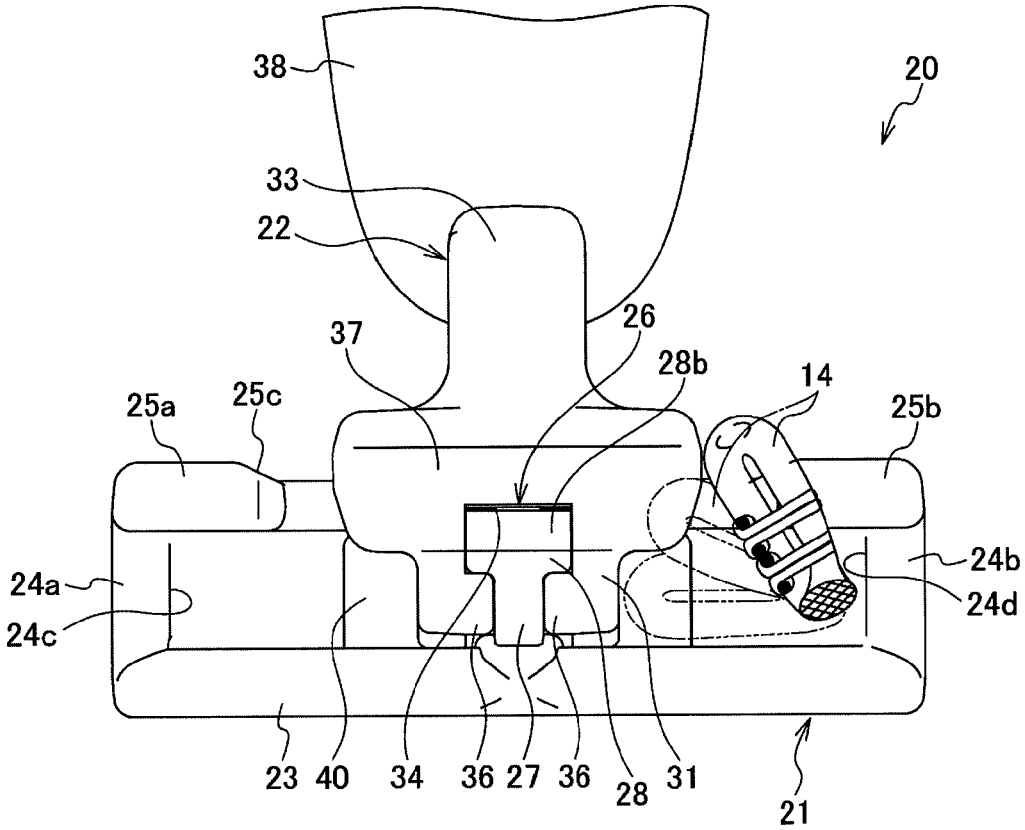
FIG. 10 is a side view of the slider for the concealed slide fastener when being viewed from a shoulder mouths-side.

Referring to FIGS. 9 and 10, the concealed slide fastener 10 includes a pair of fastener stringers 11 and a slider 20. There is used a type of the fastener stringer 11, in which each fastener element 14 is formed in a coil shape by a monofilament of a synthetic resin such as polyamide or polyester, a core string is inserted into each fastener element 14, each fastener element 14 is sewed along an element attaching edge 13 of each fastener tape 12 by sewing threads undergoing double chain stitching, a side of the element attaching edge 13 is folded in an approximately U shape, and the fastener stringer 11 is fixed in a bent shape by heat setting. Alternatively, there is also used a type of the fastener stringer 11, in which each fastener element is integrally woven into the fastener tape without using the core strings and the sewing threads.

In the concealed slide fastener 10, the fastener stringers 11 in which the meshing heads of the fastener elements 14 are opposite to each other are inserted into shoulder mouths of the slider 20, and folded portions of the fastener tapes 12 extend outwards from gaps S between first flanges 25*a* and 25*b* and a second flange 32. The left and right fastener elements 14 come out of a rear mouth of the slider 20 in a meshed state (i.e. in a closed state) by moving the slider 20 in a meshing direction (i.e. in an upward direction in FIG. 9).

As shown in FIGS. 2, 3, 5A, 5B, 5C and 5D, the slider 20 includes a slider body 21 and a slider upper plate member 22. The slider body 21 includes a lower blade 23 having a substantially trapezoidal plate shape when viewed from above, left and right side wall portions 24*a* and 24*b* erected along side edges of the lower blade 23 in a right and left direction (which is a direction perpendicular to a sliding direction of the slider 20 and is a widthwise direction of each fastener tape), left and right first flanges 25*a* and 25*b* extending from upper ends of the left and right side wall portions 24*a* and 24*b* in a mutually approaching direction, and an overhang portion 26 that is erected from the central portion of the lower blade 23 in the right and left direction at the shoulder mouths-side and has a substantially T-shape in cross section.

Here, openings disposed at a wide side of the lower blade 23 having the substantially trapezoidal plate shape, and out of which the fastener elements come in a released state are referred to as shoulder mouths, and an opening disposed at an opposite side, and out of which the fastener elements come in an engaged state is referred to as a rear mouth. Further, a direction in which the shoulder mouths and the rear mouth are connected to each other is the sliding direction of the slider 20.

The lower blade 23 has a front end edge 23*a* formed in an approximately arcuate shape. Further, a width of the lower blade 23 in the right and left direction perpendicular to the sliding direction is gradually reduced from the front end edge 23*a* to a position of about ⅔ of a total length, and then has substantially the same width up to an end edge 23*b* at the rear mouth-side.

Thus, a transverse width between the left and right side wall portions 24*a* and 24*b* erected along the side edges of the lower blade 23 having a substantially trapezoidal plate shape, and a transverse width between the left and right first flanges 25*a* and 25*b* are gradually reduced from the front end edge 23*a* to the position of about ⅔ of the total length, and then are inflected to have substantially the same width up to the end edge 23*b* at the rear mouth-side. These transverse widths have a mirror symmetry with respect to the central line of the lower blade 23. In other words, a width W2 (see FIG. 9) between inner surfaces 24*c* and 24*d* of the left and right side wall portions 24*a* and 24*b* has a substantially constant width from the rear mouth toward the shoulder mouths, and then is continuously increased.

Each of the first flanges 25*a* and 25*b* is provided with a slender taper portions 25*c* on an upper surface thereof throughout a length thereof, wherein the taper portions 25*c* is gradually lowered in an inward direction (see FIG. 10). Further, lower surfaces of the first flanges 25*a* and 25*b* are formed in parallel to the upper surface of the lower blade 23. Leading ends of the first flanges 25*a* and 25*b* at the shoulder mouths-side extend forwardly beyond the front end edge 23*a* of the lower wind plate 23, and inner angled parts of the first flanges 25*a* and 25*b* are chamfered in a round shape, and thus are formed into curved portions 25*d*. An extension length of the leading end of each of the first flanges 25*a* and 25*b* at the shoulder mouths-side from the front end edge 23*a* is preferably more than a dimension of one teeth of each fastener element 14. Further, the leading ends of the first flanges 25*a* and 25*b* at the shoulder mouths-side are formed into thick-walled portions 25*e* whose upper surfaces are swollen in an upward direction.

As described above, the slider 20 is made up of the slider body 21 and the slider upper plate member 22. A slider body-side engaging part A formed on the slider body 21 is engaged with a slider upper plate member-side engaging part B formed on the slider upper plate member 22. Thereby, the slider 20 is obtained (see FIG. 3).

In the first embodiment, the slider body-side engaging part A refers to the overhang portion 26 made up of a standing portion 27, which is erected from the central portion of the lower blade 23 in the right and left direction at the shoulder mouths-side and has a narrow plate shape, and a rib 28 that protrudes from an upper end of the standing portion 27 in a right and left direction and toward the rear mouth. The rib 28 includes a convex portion 28*a* that causes a part protruding toward the rear mouth to be reduced in width in the right and left direction, and a taper surface 28*b* at an upper potion of an side face at the shoulder mouths-side so as to be flush with an end face 37 of the slider upper plate member 22, which will be mentioned below. The overhang portion 26 may be shaped so that, when the overhang portion is engaged with a dovetail groove 34, which will be mentioned below, it is not disengaged from the lower blade 23 in a direction of the second flange 32.

Figure 4:
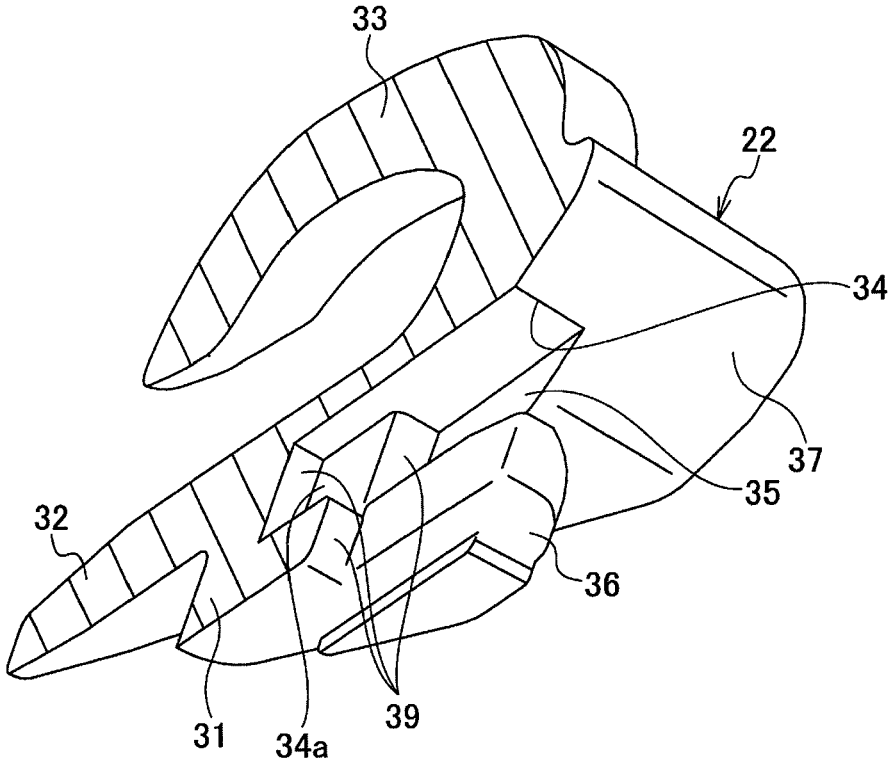
FIG. 4 is a perspective view showing a state in which the slider upper plate member shown in FIG. 3 is cut along the central line when being viewed from a diagonal downward direction.
Figure 5A:
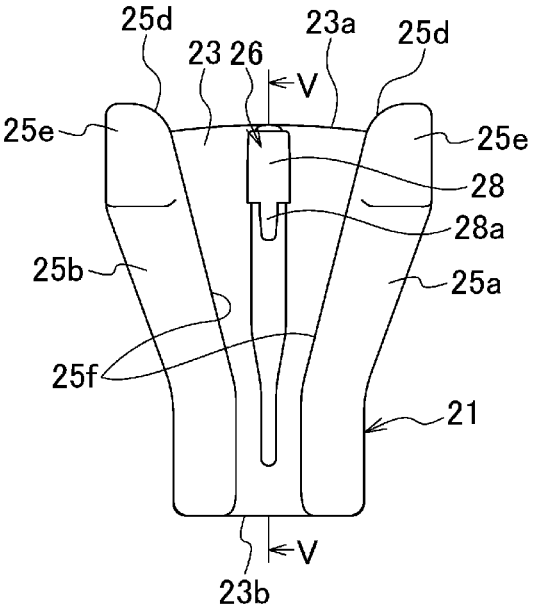
FIG. 5A is a top plan view of the slider body shown in FIG. 3.
Figure 5B:
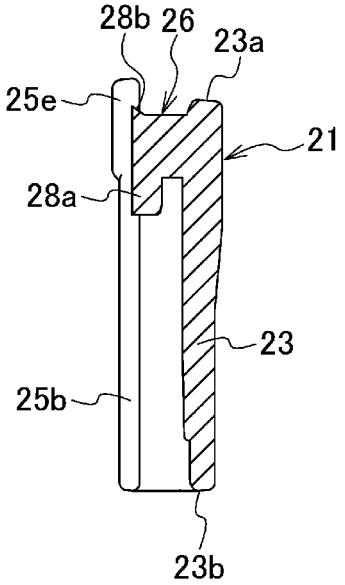
FIG. 5B is a cross-sectional view taken along line V-V.
Figure 5C:
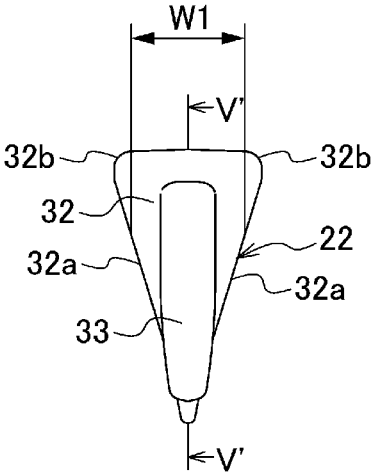
FIG. 5C is a top plan view of the slider upper plate member shown in FIG. 3.
Figure 5D:
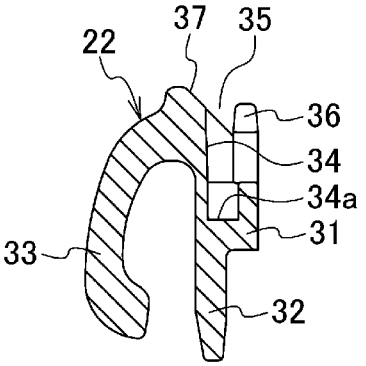
FIG. 5D is a cross-sectional view taken along line V'-V'.

Referring to FIG. 4, the slider upper plate member 22 includes a guide post 31, a second flange 32 that protrudes from an upper outer circumference of the guide post 31 toward the left and right first flanges 25*a* and 25*b* and the rear mouth, and a pull-tab attaching portion 33 of a door shape in which one end thereof is fixed to an upper surface of the second flange 32 in a cantilever form and extends in the sliding direction. The pull-tab attaching portion 33 is coupled with one end of a pull tab 38, and then the other end of the pull tab is swaged, so that the pull tab 38 is supported so as to be freely pivoted (see FIGS. 6A, 6B and 10).

The guide post 31 is formed in an approximately oval post shape in which the rear mouth side thereof has a sharp cross section, and is provided with a dovetail groove 34 in a transverse intermediate part between the guide post 31 and the second flange 32, wherein the dovetail groove 34 has an approximately T-shaped cross section and includes an opening 35 in the end of the guide post 31 on the opposite side of the rear mouth, i.e. on the side of the shoulder mouths. Further, the dovetail groove 34 includes a recess 34*a* whose upper and lower surfaces, sides, and a bottom surface are opposite to the convex portion 28*a* of the rib 28 on the rear mouth side which is located beyond the opening 35. That is, the dovetail groove 34 has the same shape as the overhang portion 26 that is the slider body-side engaging part A, and serves as the slider upper plate member-side engaging part B engaged with the overhang portion 26. Further, a pair of legs 36 are formed on ends of both left and right walls at the opening-side, by which the dovetail groove 34 is defined, and extend from the guide post 31 toward the shoulder mouths. The pair of legs 36 may be deformed so as to block the opening 35 of the dovetail groove 34.

Further, the opposite side of the opening 35 of the dovetail groove 34 is closed by contact walls 39, which are erected from a lower surface of the second flange 32 and is integrally formed with the left and right side walls forming the dovetail groove 34, and by a contact wall 39 that is erected between the recess 34*a* of the dovetail groove 34 and a bottom part of the guide post 31 and is integrally formed with the left and right side walls forming the dovetail groove 34.

The second flange 32 protruding outwardly from the outer circumference of the guide post 31 is formed in a shape of a substantially isosceles triangle whose base is the shoulder mouths-side when viewed from above. That is, the second flange 32 is configured so that a transverse width W1 continuously increases from the rear mouth side to the shoulder mouths (see FIG. 5C).

The end face 37 of the slider upper plate member 22 at the shoulder mouths-side further extends upwardly beyond the upper surface of the second flange 32, in other words, the upper surfaces of the first flanges 32. The end face 37 becomes an inclined face that is gradually inclined from the shoulder mouths-side toward the rear mouth-side as it goes downward.

Figure 8:
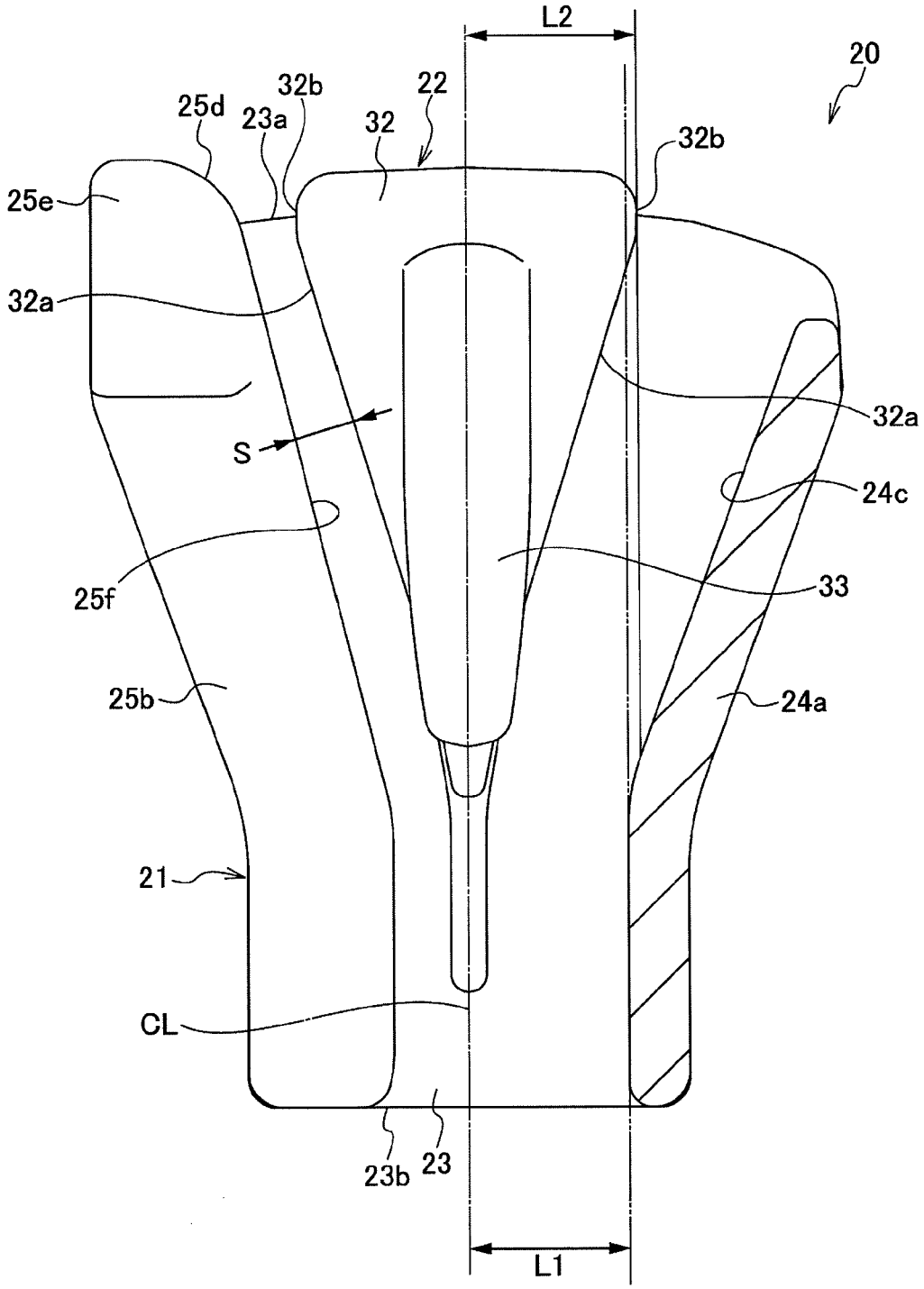
FIG. 8 is a partial cross-sectional, top plan view of the slider for the concealed slide fastener, for showing a positional relationship between the first flanges and the second flange.

Further, the end face 37 of the slider upper plate member 22 at the shoulder mouths-side is located between the front end edge 23*a* of the lower blade 23 and the leading ends of the first flanges 25*a* and 25*b* at the shoulder mouths-side (see FIG. 8).

The slider body 21 and the slider upper plate member 22 can be integrally assembled by engaging the overhang portion 26 of the slider body 21 (i.e. the slider body-side engaging part A) with the dovetail groove 34 of the slider upper plate member 22 (i.e. the slider upper plate member-side engaging part B).

Figure 6A:
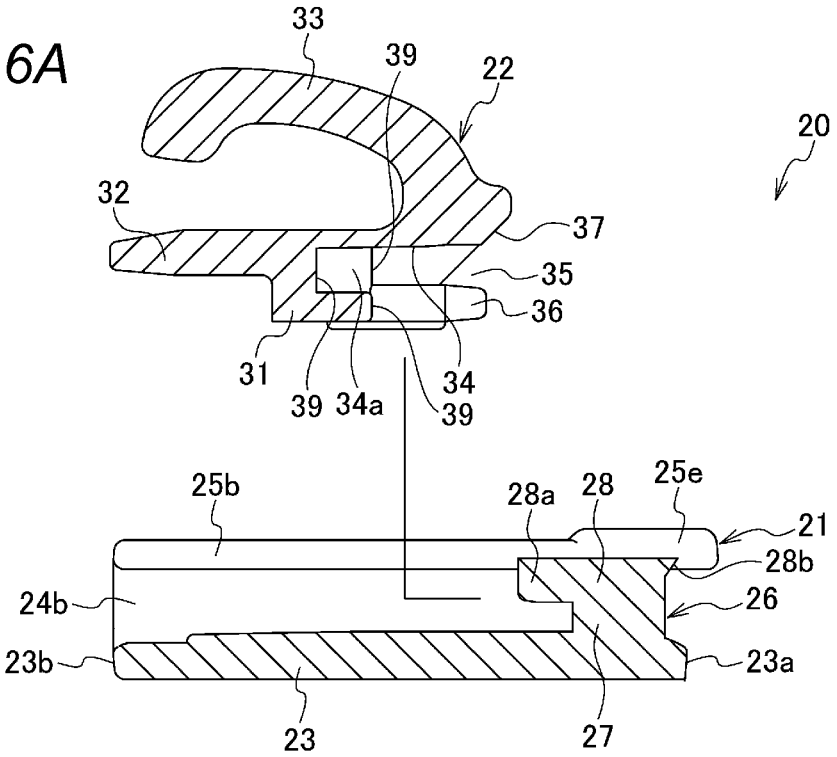
FIGS. 6A and 6B are cross-sectional views showing an assembling sequence in which the slider upper plate member is assembled into the slider body.
Figure 6B:
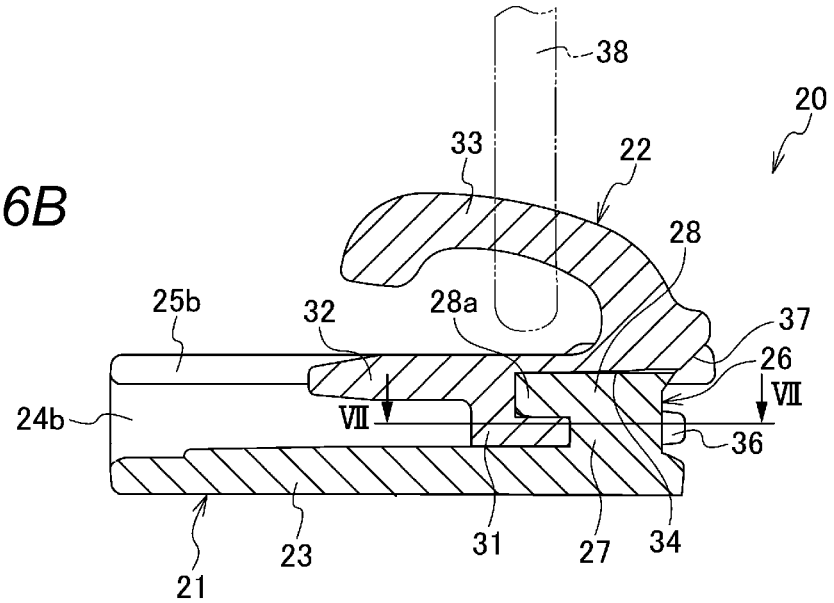
Figure 7:
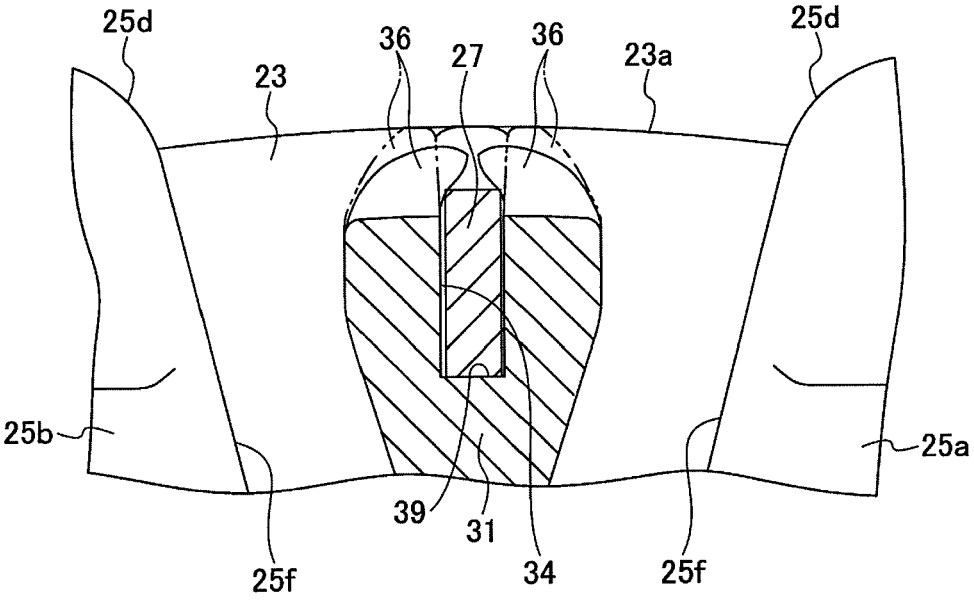
FIG. 7 is a cross-sectional view taken along line VII-VII of FIG. 6B.

In detail, as shown in FIGS. 6A, 6B and 7, the slider upper plate member 22 is relatively displaced from the rear mouth-side, which is located above the lower blade 23 between the left and right first flanges 25*a* and 25*b* of the slider body 21 and is located beyond the overhang portion 26, in a shoulder mouths direction (i.e. in a right-hand direction of FIGS. 6A and 6B), thereby fitting the recess 34*a* with the convex portion 28*a* of the rib 28, and press-fitting the overhang portion 26 (i.e. the slider body-side engaging part A) into the dovetail groove 34 (i.e. the slider upper plate member-side engaging part B). Then, the pair of legs 36 are plastic-deformed from a shape represented by a broken line to a shape represented by a solid line in FIG. 7, thereby blocking the opening 35 of the dovetail groove 34. Thereby, the overhang portion 26 is prevented from being separated from the dovetail groove 34, and the slider body 21 and the slider upper plate member 22 are integrally fixed.

Here, the overhang portion 26 is preferably press-fitted into the dovetail groove 34, so that a fixing force between the slider body 21 and the slider upper plate member 22 is increased to prevent backlash. However, the present invention is not always limited to the press-fitting. For example, the backlash may be prevented by firmly fixing the legs 36 or the like in another fixing direction.

As shown in FIG. 8, when the slider body 21 and the slider upper plate member 22 are integrally engaged with each other, outer surfaces 32*a* of the second flange 32 are approximately parallel to inner surfaces 25*f* of the left and right first flanges 25*a* and 25*b*, and a gap S having a substantially constant interval is formed between the outer surface 32*a* and the inner surface 25*f*. Further, a ratio L2/L1 of a distance L2 from a central line CL of the right and left direction perpendicular to the sliding direction of the slider 20 to each outermost end 32*b* of the second flange 32 to a distance L1 from the central line CL to each of the inner surfaces 24*c* and 24*d* of the side wall portions 24*a* and 24*b* at the rear mouth-side is set to 0.8 or more (i.e. L2/L1≥0.8).

In a conventional slider in which the slider body 21 and the second flange 32 (or the slider upper plate member 22) have been integrally molded, it is substantially difficult to set to L2/L1≥0.8 due to restrictions imposed by the structure of a metal mold. In contrast, as in the present invention, the slider 20 is made up of two components of the slider body 21 and the slider upper plate member 22, and the slider body 21 and the second flange 32 are independently formed. Thereby, the restrictions of the metal mold are removed, so that the second flange 32 can be formed in an arbitrary shape.

In view of insertability of the fastener elements 14 and slidability of the slider 20, the ratio L2/L1 is preferably set to 1 or more. In the embodiment shown in FIG. 8, the outermost ends 32*b* of the second flange 32 protrude in the right and left direction beyond the inner surfaces 24*c* and 24*d* of the side wall portions 24*a* and 24*b* at the rear mouth-side. Further, the second flange 32, the first flanges 25*a* and 25*b*, and the inner surfaces 24*c* and 24*d* of the side wall portions 24*a* and 24*b* are formed so that their widths are uniformly increased from the rear mouth side (the intermediate portion at the rear mouth-side) toward the shoulder mouths. Preferably, the outer surfaces 32*a* and the inner surfaces 25*f* are linearly formed, so that the sliding operation of the slider 20, particularly the operation in the event of the closing can be smoothly carried out.

Further, the distance L2 from the central line CL of the right and left direction to each outermost end 32*b* of the second flange 32 is set to be less than a dimension that subtracts the gap required for the passing of the fastener tape from the distance from the central line CL of the right and left direction to each inner surface 25*f* of the left and right first flanges 25*a* and 25*b*.

As shown in FIG. 9, the pair of fastener stringers 11 are inserted into the slider 20 having this shape, and the folded portions of the fastener tapes 12 extend outwardly from the gaps S between the first flanges 25*a* and 25*b* and the second flange 32. Thereby, the concealed slide fastener 10 is obtained.

In the slider 20 of this embodiment, when is viewed from a plane defined by the lower blade 23, the pair of side wall portions 24*a* and 24*b*, the guide post 31, the first flanges 25*a* and 25*b*, and the second flange 32, a substantially Y-shaped space becomes an element guide passage 40 through which the fastener elements 14 attached to the fastener stringers 11 pass.

An operation of this embodiment will be described with reference to FIGS. 9 and 10. For example, when the concealed slide fastener 10 is applied to the seat cover of a seat 1 of an automobile or the like (see FIG. 1), the concealed slide fastener 10 is in a wide open state under the lateral pulling force, which strongly pulls the left and right fastener stringers 11 in an outward direction. At this time, the fastener elements 14 prior to the insertion into the element guide passage 40 of the slider 20 may take a posture where they stand up at substantially right angles with respect to the fastener tapes 12.

To close the concealed slide fastener 10 in this state, the slider 20 slides in a meshing direction (i.e. in an upward direction in FIG. 9). Then, the fastener elements 14 of the standing posture and the fastener tapes 12 come, first, into contact with the thick-walled portions 25*e* extending toward the leading ends of the first flanges 25*a* and 25*b* of the slider body 21 at the shoulder mouths-side. As shown in FIG. 10, the left and right fastener elements 14 contacted with the thick-walled portions 25*e* are smoothly guided by the taper portions 25*c* and the curved portions 25*d* formed on the first flanges 25*a* and 25*b*, and are gradually tilted from the standing posture in which the fastener elements 14 stand up at substantially right angles.

Further, a contact pressure acting on the fastener tapes 12 when coming into contact with the thick-walled portions 25*e* is lowered by great thickness (i.e. a wide contact area) of each thick-walled portion 25, so that sliding resistance of the slider 20 is reduced, and the fastener tapes 12 is prevented from being torn. The taper portions 25*c* and the curved portions 25*d* also contribute to the reduction of the sliding resistance of the slider 20.

When the slider 20 further slides in the meshing direction, the fastener elements 14 that are tilted to a certain extent come into contact with the end face 37 of the slider upper plate member 22 at the shoulder mouths-side. Since the end face 37 becomes the inclined face that is gradually inclined from the shoulder mouths-side toward the rear mouth-side as it goes downward, the fastener elements 14 are guided along this inclined faces, and thus is further tilted.

Here, the end face 37 further extends upwardly beyond the upper surface of the second flange 32 (i.e., the upper surfaces of the first flanges 25*a* and 25*b*. As such, even when the fastener elements 14 are not sufficiently tilted and thus take a standing posture, the end face 37 can reliably contact, tilt, and guide the fastener elements 14.

The left and right fastener elements 14 contacted with the first flanges 25*a* and 25*b* are collected toward the middle portion of the slider 20 on which the guide post 31 is disposed while being guided along the first flanges 25*a* and 25*b* and the inclined end face 37, and are titled at a predetermined angle. In this state, the fastener elements 14 are smoothly guided into the element guide passage 40.

At this time, the first flanges 25*a* and 25*b* and the side wall portions 24*a* and 24*b* are continuously reduced in width at a constant angle from the shoulder mouths toward the rear mouth side. As such, although a strong lateral pulling force is applied when the slide fastener 10 is closed, it is possible to smoothly slide the slider 20.

When the first flanges 25*a* and 25*b* are molded in a shape where their widths are continuously increased from the rear mouth side toward the shoulder mouths, and when the second flange is integrally molded with the first flanges as in a conventional slider, it is difficult to increase the width of the second flange due to a metal mold relationship. Ultimately, the gaps S between the flanges 25*a* and 25*b* and the second flange 32 on the shoulder mouths-side become wide, and thus the fastener elements 14 becomes nipped in the gaps S when the concealed slide fastener 10 is closed, so that the slider 20 may have difficulty sliding.

In contrast, the slider 20 of the present invention allows the shape of the second flange 32 to be widely formed in harmony with the first flanges 25*a* and 25*b*, because the first flanges 25*a* and 25*b* (of the slider body 21) and the second flange 32 (of the slider upper plate member 22) are molded independently. Thereby, the gaps S between the flanges 25*a* and 25*b* and the second flange 32 become constant, so that the fastener elements 14 can be prevented from being nipped.

When the slider 20 is further pulled in the meshing direction, the pair of fastener elements 14 are further tilted to move along the element guide passage 40 toward the rear mouth in substantially parallel to the lower blade 23, so that they can be stably meshed with each other.

As described above, according to the concealed slide fastener 10 of the present embodiment, since the slider 20 is made up of two components of the slider body 21 and the slider upper plate member 22, the second flange 32 can be formed in an ideal shape without being restricted by the metal mold. Thereby, the fastener elements 14 taking a posture in which they stand up with respect to the fastener tapes 12 at substantially right angles are guided by the second flange 32 having the ideal shape, are properly titled and introduced into the element guide passage 40. The fastener elements 14 can be meshed while further moving toward the rear mouth side in a smooth way. Thus, although a strong lateral pulling force is applied when the slide fastener 10 is closed, it is possible to smoothly slide the slider 20.

Further, after the overhang portion 26 that is the slider body-side engaging part A formed on the slider body 21 is inserted into the opening 35 of the dovetail groove 34 at the shoulder mouths-side, that is the slider upper plate member-side engaging part B formed in the slider upper plate member 22, the legs 36 are deformed to block the opening 35, so that the slider body 21 and the slider upper plate member 22 can be reliably integrated with each other.

The slider body-side engaging part A is adapted to be engaged with the slider upper plate member-side engaging part B by relatively moving the slider upper plate member 22 from the rear mouth side to the shoulder mouths-side of the slider body 21. This engaging direction is equal to the sliding direction of the slider 20 that meshes the pair of fastener elements. Further, as shown in FIGS. 6A, 6B and 7, the contact wall 39 formed on the slider upper plate member-side engaging part B comes into contact with the end face of the overhang portion 26 at the rear mouth-side, and restricts the further movement of the slider upper plate member 22 toward the shoulder mouths-side after the slider upper plate member 22 is engaged. For example, when the concealed slide fastener of the present invention is used in a place such as an automobile seat where a strong lateral pulling force is applied, stronger sliding resistance is applied when the slider 20 is closed than when the slider 20 is opened and closed. However, this configuration is allowed to prevent the body-side engaging part A from being disengaged from the slider upper plate member-side engaging part B, although a relatively great operating force acts on the slider upper plate member 22 when the fastener elements are meshed with each other.

Furthermore, since the width W1 of the second flange 32 is formed to be continuously increased from the rear mouth toward the shoulder mouths, the fastener elements 14 can be guided by the second flange 32 and be pulled with a constant force. Thus, even when a strong lateral puffin force is applied when the slide fastener 10 is closed, it is possible to smoothly slide the slider 20.

Moreover, since the width W2 between the inner surfaces 24*c* and 24*d* of the left and right side wall portions 24*a* and 24*b* is continuously increased from the rear mouth side toward the shoulder mouths, the gaps S between the outer surfaces 32*a* of the second flange 32 and the inner surfaces 24*c* and 24*d* of the left and right side wall portions 24*a* and 24*b* can be set to a substantially constant interval. Thereby, it is possible to prevent the fastener elements 14 from being nipped in the gaps S, and thus to smoothly slide the slider 20.

Further, since the distance L2 from the central line CL of the right and left direction to each outermost end 32*b* of the second flange 32 is equal to or more than 0.8 times the distance L1 from the central line CL to each of the inner surfaces 24*c* and 24*d* of the slider body 21 at the rear mouth-side, the fastener elements 14 can be guided by the second flange 32 and be pulled with a constant and relatively weak force. Thus, even when a strong lateral pulling force is applied when the slide fastener 10 is closed, it is possible to smoothly slide the slider 20.

Further, since the end face 37 of the slider upper plate member 22 at the shoulder mouths-side extends upwardly beyond the upper surfaces of the first flanges 25*a* and 25*b*, and is gradually inclined from the shoulder mouths-side toward the rear mouth-side as it goes downward, the fastener elements 14 can be guided, tilted, and introduced into the element guide passage 40 by the end face 37, so that it is possible to smoothly slide the slider 20.

Second Embodiment

Figure 11:
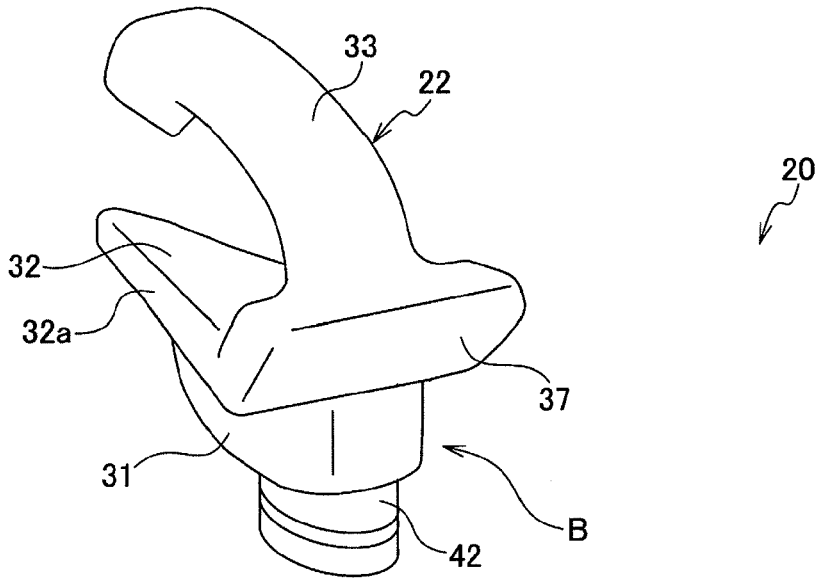
FIG. 11 is an exploded perspective view showing a slider for a concealed slide fastener according to a second embodiment of the present invention.
Figure 11:
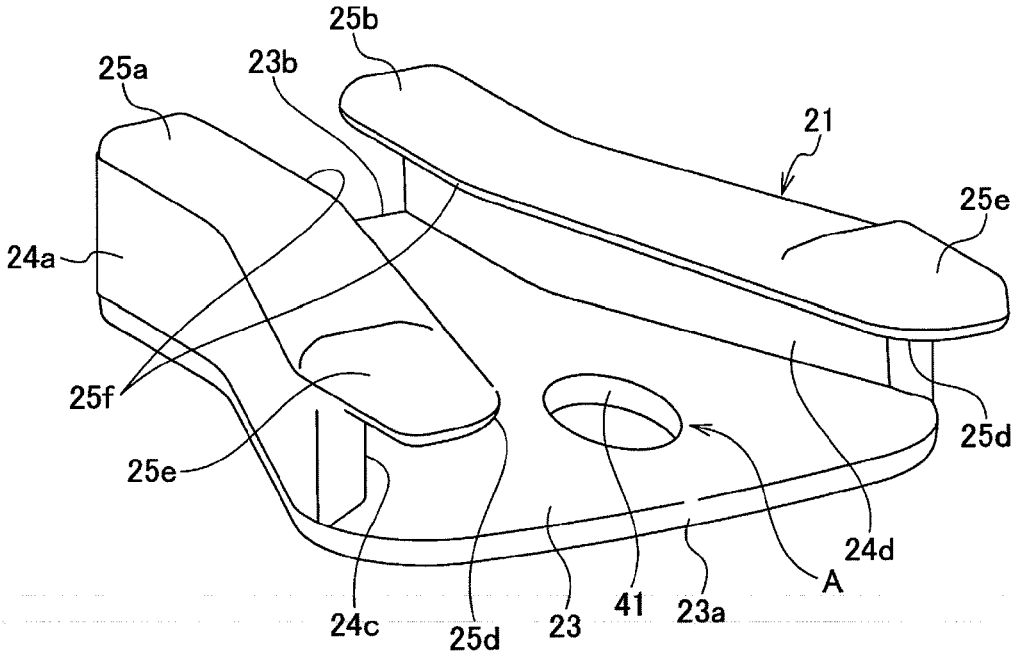

Subsequently, a slider of a second embodiment will be described with reference to FIGS. 11, 12A and 12B. FIG. 11 is an exploded perspective view showing a slider for a concealed slid fastener according to a second embodiment, and FIGS. 12A and 12B are cross-sectional views showing an assembling sequence.

As shown in FIG. 11, the slider 20 of the second embodiment is made up of a slider body 21 and a slider upper plate member 22. A lower blade 23 of the slider body 21 is provided with a fitting hole 41, as a slider body-side engaging part A, which passes through a transverse middle portion of a shoulder mouths-side thereof. Further, a guide post 31 of the slider upper plate member 22 is provided with a columnar stud 42, as a slider upper plate member-side engaging part B, which protrudes downwardly from the guide post 31. Further, a fitting recess 41*a*, which receives a bulge portion of the columnar stud 42*a* of the slider upper plate member 22, is formed in a lower surface of the lower blade around the fitting hole 41.

As shown in FIGS. 12A and 12B, the columnar stud 42 of the slider upper plate member 22 is force-fitted into the fitting hole 41 of the slider body 21, and then a lower end of the columnar stud 42 is pressed and crushed by a press or the like. Thereby, the bulge portion is spread in the fitting recess 41*a*, is swaged in the fitting hole 41, so that the slider upper plate member 22 is fixed to the slider body 21.

According to the slider 20 of the present embodiment, the slider body 21 can be simplified in shape and be reduced in production cost.

Configuration and operation of the others are the same as those of the first embodiment.

On the other hand, in the present embodiment, the fitting hole 41 and the columnar stud 42 are formed in an oval shape, thereby preventing the slider upper plate member 22 from rotating relative to the slider body 21. However, the fitting hole 41 and the columnar stud 42 may be formed as an angled hole and an angle strut respectively, thereby preventing their relative rotation.

Third Embodiment

Figure 13A:
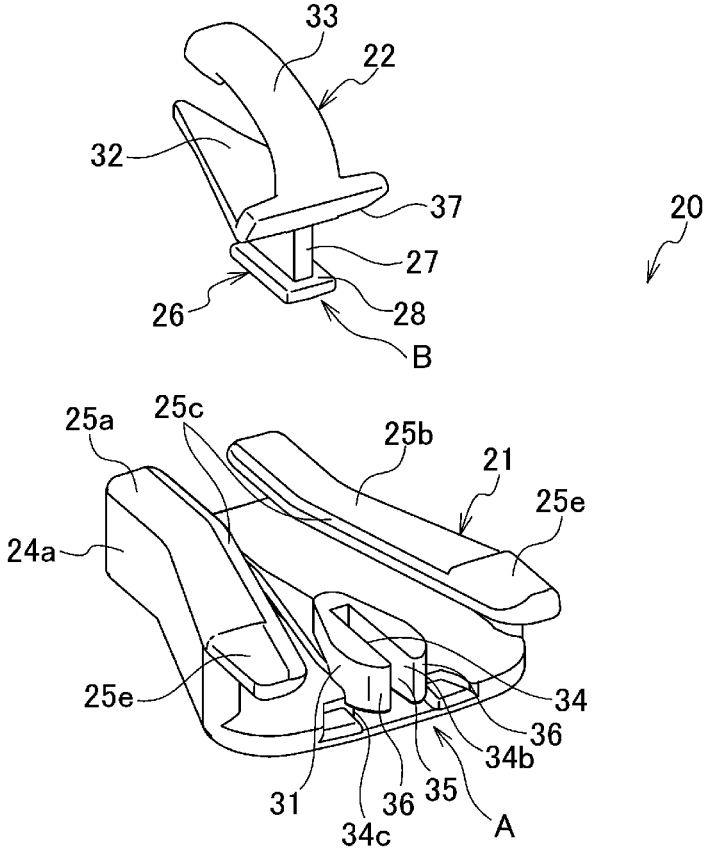
FIG. 13A is an exploded perspective view showing a second modification of a slider for a concealed slide fastener according to a third embodiment of the present invention.

Next, a slider of a third embodiment will be described with reference to FIGS. 13A and 13B. FIG. 13A is an exploded perspective view showing a slider for a concealed slid fastener according to a third embodiment, and FIG. 13B is a perspective view showing an assembled slider.

Figure 13B:
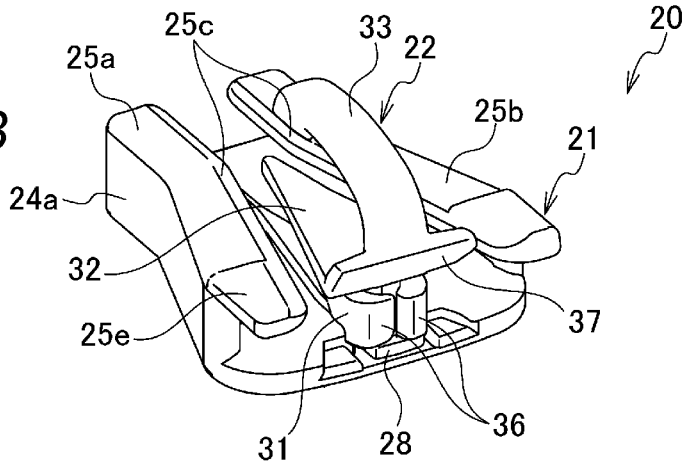
FIG. 13B is a perspective view of the slider for the concealed slide fastener after being assembled.

As shown in FIGS. 13A and 13B, the slider 20 of the third embodiment is configured in opposition to the slider of the first embodiment, in which a guide post 31 and a dovetail groove 34, which serve as a slider body-side engaging part A, is provided in a slider body 21, and a reverse T-shaped overhang portion 26, as a slider upper plate member-side engaging part B, engaged with the dovetail groove 34 is provided in a slider upper plate member 22. The dovetail groove 34 is a reverse T-shaped grooved, A narrow recess 34*b* is formed in the guide post 31, and a wide recess 34*c* is formed as a hollow recess between a lower portion of the guide post 31 and the lower blade 23. Further, an opening 35 of the dovetail groove 34 is formed on a shoulder mouths-side of the guide post 31.

The slider 20 press-fits the overhang portion 26 of the slider upper plate member 22 into the dovetail groove 34 of the slider body 21 from the shoulder mouths-side, and then a pair of legs 36 formed on the shoulder mouths-side of the guide post 31 are plastic-deformed to block the opening 35. Thereby, the slider body 21 and the slider upper plate member 22 are integrally fixed.

Configuration and operation of the others are the same as those of the first embodiment.

On the other hand, although not shown, the opening 35 described in the third embodiment may not be formed on the should mouth side but a rear mouth side, and a contact wall 39 closing the opening 35 of the dovetail groove 34 may be integrally formed with sidewalls constituting the lower blade 23 and the dovetail groove 34. This configuration prevents the slider 20 from being damaged even when fastener elements 14 of fastener tapes 12 to which a strong lateral pulling force is applied are meshed with each other as in first embodiment.

Fourth Embodiment

Figure 14A:
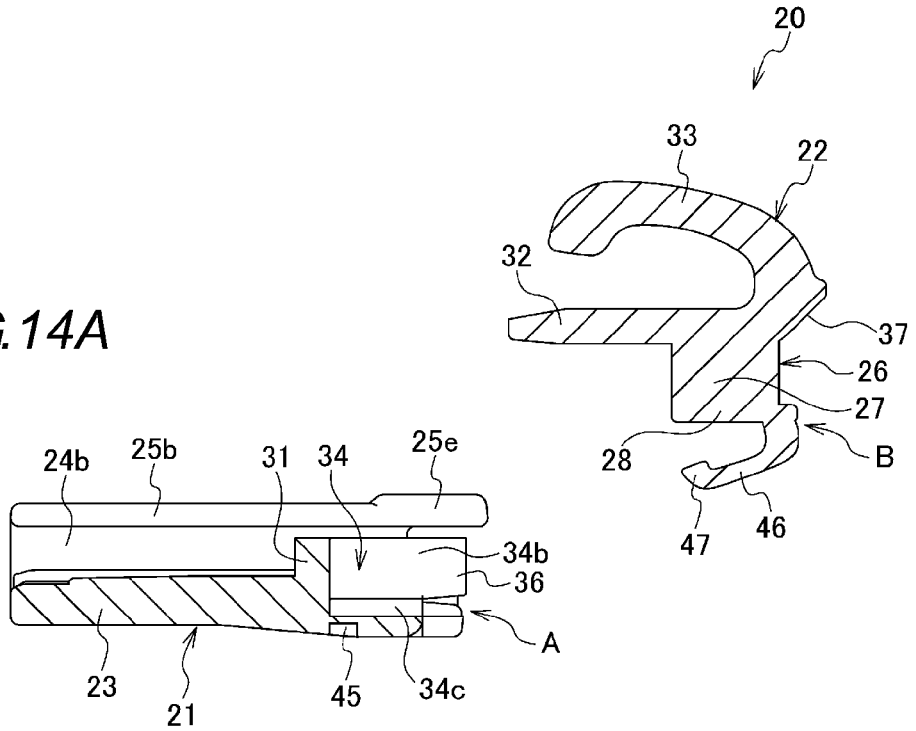
FIG. 14A is an exploded perspective view showing a slider for a concealed slide fastener according to a fourth embodiment of the present invention.

Next, a slider of a fourth embodiment will be described with reference to FIGS. 14A and 14B. FIG. 14A is an exploded cross-sectional view showing a slider for a concealed slid fastener according to a third embodiment, and FIG. 14B is a perspective view showing an assembled slider.

Figure 14B:
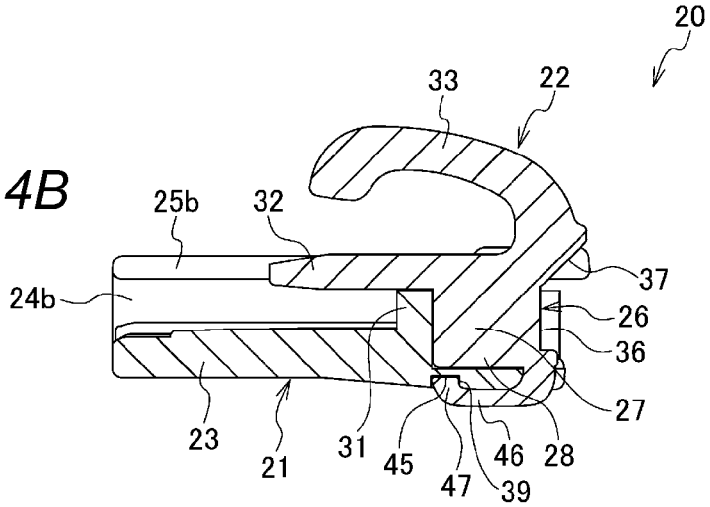
FIG. 14B is a cross-sectional view of the slider for the concealed slide fastener after being assembled.

As shown in FIGS. 14A and 14B, the slider 20 of the fourth embodiment is different from the slider 20 of the third embodiment in that to prevent separation between a slider body 21 and a slider upper plate member 22, one spot is additionally provided in addition to a pair of plastic-deformed legs 36, in addition to the configuration of the third embodiment. In detail, an engaging recess 45 is formed in a lower surface of a lower blade 23 in the slider body 21, and a door-shaped engaging arm 46 extends from a lower surface of an overhang portion at the shoulder mouths-side toward a rear mouth in the slider upper plate member 22. A leading end of the engaging arm 46 is provided with a hook 47 fitted into the engaging recess 45.

In the slider 20 of the fourth embodiment, the overhang portion 26 of the slider upper plate member 22 is press-fitted into a dovetail groove 34 of the slider body 21 from the shoulder mouths-side, and a pair of legs 36 is plastic-deformed to block an opening 35. In addition, the engaging arm 46 is plastic-deformed to fit the hook 47 into the engaging recess 45. Thereby, the slider body 21 and the slider upper plate member 22 are integrally assembled. The slider body 21 and the slider upper plate member 22 are configured to prevent the slider upper plate member 22 from being separated from the slider body 21 at two spots of the pair of plastic-deformed legs 36 and the hook 47 fitted into the engaging recess 45.

In the fourth embodiment, the hook 47 fitted into the engaging recess 45 serves as a contact wall 39 that restricts further movement of the slider upper plate member 22 toward the shoulder mouths-side after the slider upper plate member 22 is engaged.

According to the slider 20 of the present embodiment, even when a sliding direction of the slider 20 meshing the pair of fastener stringers 11 (fastener elements 14) is matched with a direction of the slider upper plate member 22 that releases the engagement between the slider body 21 and the slider upper plate member 22, it is possible to engage slider body 21 and the slider upper plate member 22 with each other.

Configuration and operation of the others are equal to those of the third embodiment.

On the other hand, the present invention is not limited to the aforementioned embodiments, but may be properly deformed or improved.

For example, the shape of the pull-tab attaching portion is not substantially limited, and thus may be properly modified. For instance, as shown in FIG. 15, the pull-tab attaching portion 48 may be formed in a ring shape.

Figure 15:
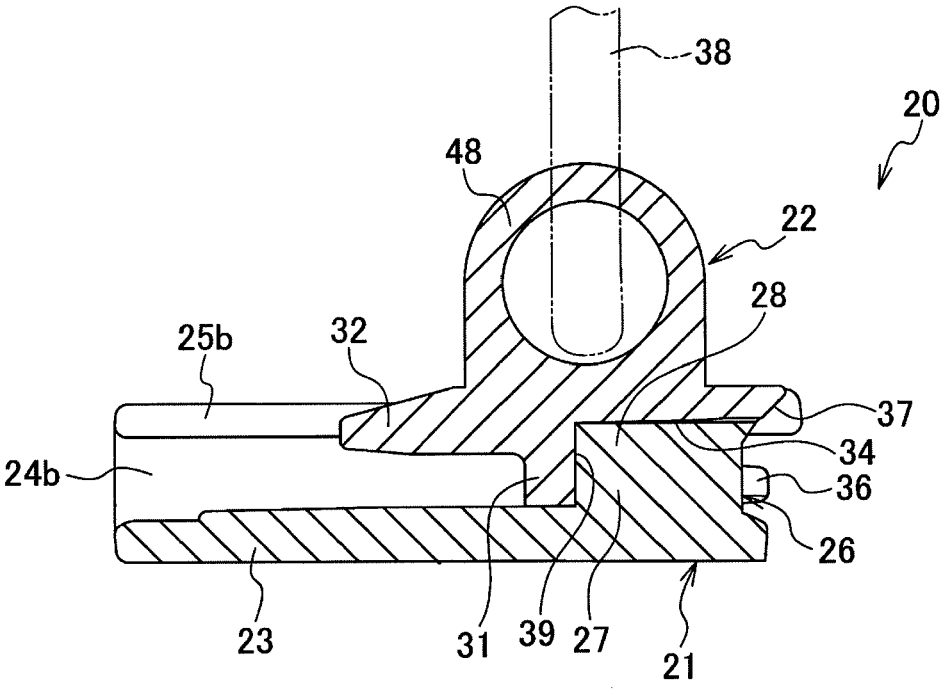
FIG. 15 is a cross-sectional view showing a slider for a concealed slide fastener according to a modification of the present invention.

Meanwhile, FIG. 15 shows that, as described above, the rib 28 of the overhang portion 26 may protrude from the standing portion 27 only in a right and left direction without the convex portion 28*a*.

Figure 16:
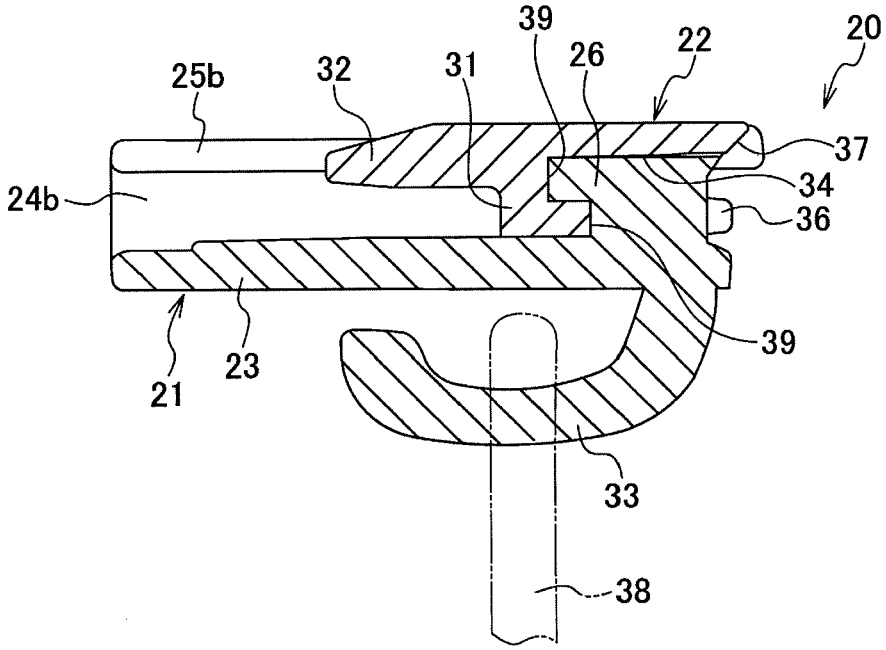
FIG. 16 is a cross-sectional view showing a slider for a concealed slide fastener according to another modification of the present invention.

Further, in the above embodiments, the pull-tab attaching portion 33 is attached to the slider upper plate member 22. However, as shown in FIG. 16, the pull-tab attaching portion 33 may extend from the lower surface of the lower blade 23 of the slider body at the shoulder mouths-side in the sliding direction.

Further, in the above embodiments, the concealed slide fastener has been described as one in which the coil-shape element is stitched to each fastener tape, but it is not limited to this concealed slider fastener. Thus, a concealed slide fastener in which each element is independently attached to each fastener tape may be used.

REFERENCE NUMERALS

10 Concealed slide fastener
11 Fastener stringer
12 Fastener tape
13 Element attaching edge (side edge)
14 Fastener element
20 Slider
21 Slider body
22 Slider upper plate member
23 Lower blade
24*a* Side wall portion
24*b* Side wall portion
24*c* Inner surface

24*d* Inner surface
25*a* First flange
25*b* First flange
26 Overhang portion (slider body-side engaging part)
27 Standing portion
28 Rib
31 Guide post
32 Second flange
32*b* Outermost end
33 Pull-tab attaching portion
34 Dovetail groove (slider upper plate member-side engaging part)
35 Opening
36 Leg
37 End face (inclined face)
38 Pull tab
39 Contact wall
48 Pull-tab attaching portion
A Slider body-side engaging part
B Slider upper plate member-side engaging part
CL Central line aright and left direction
L1 Distance from central line to inner surface of side wall portion
L2 Distance from central line to outermost end of second flange
W1 Width of second flange
W2 Width between inner surfaces of side wall portions

The invention claimed is:

1. A slider for a concealed slide fastener which engages and disengages fastener elements of a pair of fastener stringers in which opposite side edges of fastener tapes are bent and fixed into U-shapes and the fastener elements are attached along bent end edges of the side edges, the slider comprising:

a lower blade;

left and right side wall portions erected along side edges of the lower blade in a right and left direction;

left and right first flanges extending from upper ends of the left and right side wall portions in a mutually approaching direction;

a guide post disposed between the left and right first flanges and extending from a central portion of the lower blade in the right and left direction at a side of shoulder mouths of the slider toward a rear mouth of the slider; and a second flange protruding from an upper portion of the guide post toward at least the left and right first flanges and the rear mouth, wherein the slider is comprised of a slider body having at least the lower blade, the left and right side wall portions and the left and right first flanges, and a slider upper plate member engaged with the slider body and having at least the second flange, wherein the guide post is provided in one of the slider body and the slider upper plate member, wherein leading ends of the left and right first flanges at the side of the shoulder mouths of the slider extend forwardly beyond a front end edge of the guide post, wherein the second flange and the left and right first flanges are formed so as to uniformly increase in widths thereof from a side of the rear mouth of the slider to the front end edge of the guide post, and wherein outer surfaces of the second flange are substantially parallel to inner surfaces of the left and right first flanges such that gaps each having a substantially constant interval are formed between the outer surfaces of the second flange and the inner surfaces of the left and right first flanges.

2. The slider for the concealed slide fastener, according to claim 1, wherein the slider body includes a slider body-side engaging part formed at a central portion of the lower blade in the right and left direction at the side of the shoulder mouths of the slider, and wherein the slider upper plate member includes a slider upper plate member-side engaging part engaged with the slider body-side engaging part and formed below the second flange.

3. The slider for the concealed slide fastener, according to claim 2, wherein the slider upper plate member is configured such that the slider body-side engaging part is engaged with the slider upper plate member-side engaging part by relatively moving the slider upper plate member from the side of the rear mouth of the slider toward the shoulder mouths of the slider, and wherein one of the slider body-side engaging part and the slider upper plate member-side engaging part is integrally formed with a contact wall that restricts the slider upper plate member after engagement from moving further toward the shoulder mouths of the slider.

4. The slider for the concealed slide fastener, according to claim 3, wherein one of the slider body-side engaging part and the slider upper plate member-side engaging part is a dovetail groove that is opened to one of the side of the shoulder mouths of the slider and the side of the rear mouth of the slider, and wherein the other of the slider body-side engaging part and the slider upper plate member-side engaging part is an overhang portion having a shape corresponding to the dovetail groove and comprised of a standing portion and a rib protruding from an upper end of the standing portion in the right and left direction, the overhang portion having a substantially T-shape in cross section.

5. The slider for the concealed slide fastener, according to claim 4, wherein an opposite side of an opening at which the dovetail groove is opened is closed by the contact wall.

6. The slider for the concealed slide fastener, according to claim 5, wherein the guide post is provided in the slider upper plate member, wherein the slider upper plate member-side engaging part is provided with the dovetail groove that is opened to the side of the shoulder mouths of the slider and a pair of legs which are deformable so as to block the opening of the dovetail groove, wherein the slider body-side engaging part is the overhang portion having the substantially T-shape in cross section and comprised of the standing portion erected from the lower blade and the rib protruding outwardly from the upper end of the standing portion toward the left and right first flanges, and wherein the pair of legs are deformed so as to block the opening after the overhang portion is inserted into the dovetail groove from the side of the shoulder mouths of the slider.

7. The slider for the concealed slide fastener, according to claim 1, wherein the left and right side wall portions are configured such that a width between inner surfaces at the side of the shoulder mouths of the slider is continuously increased from the rear mouth of the slider toward the shoulder mouths of the slider.

8. A slider for a concealed slide fastener which engages and disengages fastener elements of a pair of fastener stringers in which opposite side edges of fastener tapes are bent and fixed into U-shapes and the fastener elements are attached along bent end edges of the side edges, the slider comprising:

a lower blade;

left and right side wall portions erected along side edges of the lower blade in a right and left direction;

left and right first flanges extending from upper ends of the left and right side wall portions in a mutually approaching direction;

a guide post disposed between the left and right first flanges and extending from a central portion of the lower blade in the right and left direction at a side of shoulder mouths of the slider toward a rear mouth of the slider; and a second flange protruding from an upper portion of the guide post toward at least the left and right first flanges and the rear mouth, wherein the slider is comprised of a slider body having at least the lower blade, the left and right side wall portions and the left and right first flanges, and a slider upper plate member engaged with the slider body and having at least the second flange, wherein the guide post is provided in one of the slider body and the slider upper plate member, and wherein the outermost ends of the second flange protrude in the right and left direction beyond the inner surfaces of the side wall portions at the side of the rear mouth of the slider.

9. The slider for the concealed slide fastener, according to claim 1, wherein an end face of the slider upper plate member at the side of the shoulder mouths of the slider has an inclined face that is gradually inclined from the shoulder mouths of the slider toward the rear mouth of the slider as it goes downward, and wherein the inclined face extends upward beyond an upper surface of each of the first flanges.

10. A slider for a concealed slide fastener which engages and disengages fastener elements of a pair of fastener stringers in which opposite side edges of fastener tapes are bent and fixed into U-shapes and the fastener elements are attached along bent end edges of the side edges, the slider comprising:

a lower blade;

left and right side wall portions erected along side edges of the lower blade in a right and left direction;

left and right first flanges extending from upper ends of the left and right side wall portions in a mutually approaching direction;

a guide post disposed between the left and right first flanges and extending from a central portion of the lower blade in the right and left direction at a side of shoulder mouths of the slider toward a rear mouth of the slider; and a second flange protruding from an upper portion of the guide post toward at least the left and right first flanges and the rear mouth, wherein the slider is comprised of a slider body having at least the lower blade, the left and right side wall portions and the left and right first flanges, and a slider upper plate member engaged with the slider body and having at least the second flange, wherein the guide post is provided in the slider upper plate member, wherein the slider body includes a slider body-side engaging part formed at a central portion of the lower blade in the right and left direction at the side of the shoulder mouths of the slider, wherein the slider upper plate member includes a slider upper plate member-side engaging part engaged with the slider body-side engaging part and formed below the second flange, wherein the slider upper plate member is configured such that the slider body-side engaging part is engaged with the slider upper plate member-side engaging part by relatively moving the slider upper plate member from a side of the rear mouth of the slider toward the shoulder mouths of the slider, wherein the slider upper plate member-side engaging part is integrally formed with a contact wall that restricts the slider upper plate member after engagement from moving further toward the shoulder mouths of the slider, wherein the guide post is formed at a lower side of the slider upper plate member, wherein the slider upper plate member-side engaging part is a dovetail groove that is opened to the side of the shoulder mouths of the slider, wherein the slider body-side engaging part is an overhang portion having a shape corresponding to the dovetail groove and comprised of a standing portion and a rib protruding from an upper end of the standing portion in the right and left direction, the overhang portion having a substantially T-shape in cross section, wherein an opposite side of an opening at which the dovetail groove is opened is closed by the contact wall, wherein the slider upper plate member-side engaging part is provided with the dovetail groove and a pair of legs which are deformable so as to block the opening of the dovetail groove, and wherein the pair of legs are deformed so as to block the opening after the overhang portion is inserted into the dovetail groove from the side of the shoulder mouths of the slider.

11. The slider for the concealed slide fastener, according to claim 1, further comprising a pull-tab attaching portion for supporting a pull-tab, wherein the pull-tab attaching portion is provided in one of the slider body and the slider upper plate member.

12. The slider for concealed slide fastener, according to claim 8, further comprising a pull-tab attaching portion for supporting a pull-tab, wherein the pull-tab attaching portion is provided in one of the slider body and the slider upper plate member.

13. The slider for concealed slide fastener, according to claim 10, further comprising a pull-tab attaching portion for supporting a pull-tab, wherein the pull-tab attaching portion is provided in one of the slider body and the slider upper plate member.

14. The slider for the concealed slide fastener, according to claim 13, wherein the pull-tab attaching portion is provided on an upper surface of the second flange.

15. The slider for the concealed slide fastener, according to claim 13, wherein the pull-tab attaching portion extends on a lower surface of the lower blade.

* * * * *

UNITED STATES PATENT AND TRADEMARK OFFICE

CERTIFICATE OF CORRECTION

PATENT NO. : 9,038,249 B2
APPLICATION NO. : 13/392547
DATED : May 26, 2015
INVENTOR(S) : Keiichi Keyaki et al.

It is certified that error appears in the above-identified patent and that said Letters Patent is hereby corrected as shown below:

On The Title Page,

In item (57), in column 2, under "Abstract", line 1, delete "Providing a" and insert -- A --, therefor.

In item (57), in column 2, under "Abstract", line 5, delete "comprises" and insert -- includes --, therefor.

In item (57), in column 2, under "Abstract", line 7, after "right first flanges, and" insert -- a --.

In The Specification,

In column 9, line 66, delete "potion" and insert -- portion --, therefor.

In column 14, line 13, delete "puffin" and insert -- pulling --, therefor.

In column 17, line 21, delete "aright" and insert -- of right --, therefor.

Signed and Sealed this
Tenth Day of November, 2015

Michelle K. Lee

Michelle K. Lee
*Director of the United States Patent and Trademark Office*